US005598478A

United States Patent [19]

Tanaka et al.

[11] Patent Number: 5,598,478

[45] Date of Patent: Jan. 28, 1997

[54] SOUND IMAGE LOCALIZATION CONTROL APPARATUS

[75] Inventors: Yoshiaki Tanaka, Fujisawa; Hiroshi Hayashi, Tokyo; Norihiko Fuchigami, Yokohama; Masahiro Nakayama, Sagamihara; Takuma Suzuki; Mitsuo Matsumoto, both of Yokosuka, all of Japan

[73] Assignee: Victor Company of Japan, Ltd., Yokohama, Japan

[21] Appl. No.: 169,198

[22] Filed: Dec. 20, 1993

[30] Foreign Application Priority Data

| | | | |
|---|---|---|---|
| Dec. 18, 1992 | [JP] | Japan | 4-355759 |
| Dec. 21, 1992 | [JP] | Japan | 4-356358 |
| Dec. 28, 1992 | [JP] | Japan | 4-361642 |

[51] Int. Cl.[6] ..... H04R 5/00

[52] U.S. Cl. ..... 381/17

[58] Field of Search ..... 381/17, 26; 273/435

[56] References Cited

U.S. PATENT DOCUMENTS

| | | | |
|---|---|---|---|
| 3,236,949 | 2/1966 | Atal et al. | 381/17 |
| 5,404,406 | 4/1995 | Fuchigami et al. | 381/17 |

FOREIGN PATENT DOCUMENTS

| | | | |
|---|---|---|---|
| 58-138165A | 8/1983 | Japan | H04N 1/02 |
| 0206300 | 12/1983 | Japan | 381/17 |
| 405168097 | 7/1993 | Japan | 381/17 |

*Primary Examiner*—Edward L. Coles, Sr.
*Assistant Examiner*—Jerome Grant, II
*Attorney, Agent, or Firm*—Pollock, Vande Sande & Priddy

[57] ABSTRACT

A sound image localization control apparatus provided with a pair of convolvers for performing a convolution operation on signals sent from a common sound source, a storage unit for storing groups of coefficients of localization filters (namely, impulse responses) corresponding to each of locations of sound images and a coefficient supply unit for supplying the coefficients corresponding to a designated location of a sound image to the convolvers. The sound image localization control apparatus can make a listener feel as if sound images are localized in a large space as subtending a visual angle of more than 180 degrees at his eye. The sound image localization control apparatus is further provided with a synchronization unit for localizing a sound image in synchronization with an image reproduced on the screen of a monitor. The sound image localization control apparatus can provide virtual reality with more realistic presence.

11 Claims, 19 Drawing Sheets

SOUND-IMAGE-LOCATION CHANGING INSTRUCTION

FEED NEW COEFFICIENTS

CROSS FADING CONTROL SIGNAL

FADERS 21R & 21L (FADE OUT)
max
min

FADERS 22R & 22L (FADE IN)
max
min
CROSS FADING TIME

SOUND IMAGE LOCALIZATION CONTROL APPARATUS

BACKGROUND OF THE INVENTION

1. Field of The Invention

This invention generally relates to an apparatus for controlling the localization (hereunder sometimes referred to as sound image localization) of a sound source image. A sound source image is a listener's acoustic and subjective image of a sound source and will hereunder be referred to simply as a sound image. The control is in such a manner as to make a listener feel that he hears sounds emitted from a virtual sound source (namely, the sound image) which is located at a desired position different from the position of a transducer (for example, a speaker). More particularly a sound-image-localization control apparatus is provided which can be employed by what is called an amusement game machine (namely, a computer game (or video game) device), a computer terminal or the like, and which is reduced in size without hurting the above described listener's feeling about the sound image localization.

2. Description of The Related Art

A conventional sound image localization method employs what is called a binaural technique which utilizes the signal level difference and phase difference (namely, time difference) of a same sound signal issued from a sound source between the ears of a listener and makes the listener feel as if the sound source were localized at a specific position (or in a specific direction) which is different from the actual position of the sound source (or the actual direction in which the sound source is placed).

A conventional sound image localization method utilizing an analog circuit, which was developed by the Applicant of the instant application, is disclosed in, for example, the Japanese Laying-open Patent Application Publication Official Gazette (Tokkyo Kokai Koho) NO. S53-140001 (namely, the Japanese Patent Publication Official Gazette (Tokkyo Kokoku Koho) NO. S58-3638). This conventional method is adapted to enhance and attenuate the levels of signal components of a specific frequency band (namely, controls the amplitude of the signal) by using an analog filter such that a listener can feel the presence of a sound source in front or in the rear. Further, this conventional method employs analog delay elements to cause the difference in time or phase between sound waves respectively coming from the left and right speakers (namely, controls the phase of the signal) such that a listener can feel the presence of the sound source at the left or right side of him.

Further, there has been another conventional sound image localization method realized with the recent progress of digital processing techniques, which is disclosed in, for instance, the Japanese Laying-open Patent Application Publication Official Gazette NO. H2-298200 (incidentally, the title of the invention is "IMAGE SOUND FORMING METHOD AND APPARATUS").

In case of this sound image localization apparatus using a digital circuit, a fast Fourier transform (FFT) is first performed on a signal issued from a sound source to effect what is called a frequency-base (or frequency-dependent-basis) processing, namely, to give signal level difference and a phase difference, which depend on the frequencies of signals, to left and right channel signals. Thus, the digital control of sound image localization is achieved. In case of this conventional apparatus, the signal level difference and the phase difference at a position at which each sound image is located, which differences depend on the frequencies of signals, are collected as experimental data by utilizing actual listeners.

Such a sound image localization apparatus using a digital circuit, however, has drawbacks in that the size of the circuit becomes extremely large when the sound image localization is achieved precisely and accurately. Therefore, such a sound image localization apparatus is employed only in a recording system for special business use. In such a system, a sound image localization processing (for example, the shifting of an image position of a sound of an air plane) is effected at a recording stage and then sound signals (for instance, signals representing music) obtained as the result of the processing are recorded. Thereafter, the effects of shifting of a sound image is obtained by reproducing the processed signal by use of an ordinary stereophonic reproducing apparatus.

Meanwhile, there have recently appeared what is called an amusement game machine and a computer terminal, which utilize virtual reality. Further, such a machine or terminal has come to require real sound image localization suited to a scene displayed on the screen of a display thereof.

For example, in case of a computer game machine, it has become necessary to effect a shifting of the sound image of a sound of an air plane, which is suited to the movement of the air plane displayed on the screen. In this case, if the course of the air plane is predetermined, sounds (or music) obtained as the result of shifting the sound image of the sound of the air plane in such a manner to be suited to the movement of the air plane are recorded preliminarily. Thereafter, the game machine reproduces the recorded sounds (or music) simply and easily.

However, in case of such a game machine (or computer terminal), the course (or position) of an air plane changes according to manipulations performed by an operator thereof. Thus, it has become necessary to perform a real-time shifting of a sound image according to manipulations effected by the operator in such a way to be suited to the manipulations and thereafter reproduce sounds recorded as the result of the shifting of the sound image.

Such a processing is largely different in this respect from the above described sound image localization for recording.

Therefore, each game machine should be provided with a sound image localization device. However, in case of the above described conventional method, it is necessary to perform an FFT on signals emitted from a sound source and the frequency-base processing and to effect an inverse FFT for reproducing the signals. As the result, the size of a circuit used by this conventional apparatus becomes very large. Consequently, this conventional apparatus cannot be a practical measure for solving the problem. Further, in case of the above described conventional apparatus, the sound image localization is based on frequency-base data (namely, data representing the signal level difference and the phase difference which depend on the frequency of a signal). Thus, the above described conventional apparatus has a drawback in that when an approximation processing is performed to reduce the size of the circuit, a head-related transfer function (HRTF) (thus, head-related transfer characteristics) cannot be accurately approximated and that it is not possible to have transfer characteristics correspondingly to all of visual angles from 0 to 360 degrees, which are subtended at a listener's eye.

Namely, as in case of "Interactive Video Game Apparatus" disclosed in the Japanese Laying-open Patent Application Publication Official Gazette NO. H4-242684, sound image localization is effected by preparing only transfer characteristics (namely, coefficients) corresponding to azimuth angles of 90 degrees leftwardly and rightwardly (namely, clockwise and counterclockwise) from the very front of an operator and then performing substantially what is called a pan pot processing on a reproduced sound corresponding to the direction of the very front of the operator and a localization reproduction sound corresponding to each of azimuth angles of 30 degrees leftwardly and rightwardly therefrom (namely, localizing a sound image at an intermediate location by changing the ratio at which the reproduced sound is mixed with the localization reproduction sound).

However, in case of performing such a simple processing, it is difficult to localize a sound image in a large space as subtending a visual angle of more than 180 degrees at a listener's eye (especially, in the rear of the listener).

The present invention is created to eliminate the above described defects of the conventional apparatus.

SUMMARY OF THE INVENTION

It is, accordingly, an object of the present invention to provide a sound image localization control apparatus for controlling sound image localization, which can reduce the size and cost of a circuit to be used and can localize a sound image in a large space subtending a visual angle of more than 180 degrees at a listener's eye and can achieve excellent sound image localization.

Further, aspects of such a sound image localization control apparatus are as follows.

First, an aspect of such an apparatus resides in that a sound image is localized by processing signals issued from a sound source on a time base or axis by use of a pair of convolvers. Thereby, the size of the circuit can be very small. Further, this apparatus can be employed in a game machine for private or business use.

Moreover, another aspect of such an apparatus resides in that data for a sound image localization processing by the convolvers is supplied as data for a time-base impulse response (IR). Thereby, an HRTF (thus, head-related transfer characteristics) can be accurately approximated without deteriorating the sound image localization and the size of a circuit (thus, the number of coefficients of the convolvers) can be even smaller.

Furthermore, a further aspect of such an apparatus resides in that the reduced number of coefficients of the convolvers are provided as the characteristics corresponding to all of the locations of the sound images (namely, corresponding to all of visual angles from 0 to 360 degrees, which are subtended at a listener's eye) and that sound image localization is effected by supplying and setting the coefficients corresponding to an indicated location of a sound image (hereunder sometimes referred to as a sound image location).

Additionally, still another aspect of the present invention resides in that virtual reality can be provided with realistic presence by synchronizing display of an image on the screen of a monitor with a sound image localization according to an operation effected by an operator.

Further, yet another aspect of the present invention resides in that the generation of noises can be prevented by changing the coefficients of the convolvers by performing what is called a cross fading.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, preferred embodiments of the present invention will be described in detail by referring to the accompanying drawings.

First, the fundamental principle of the sound image localization control method employed in the preferred embodiments according to (namely, the sound image localization control apparatuses embodying) the present invention will be explained hereinbelow. This technique is employed to localize a sound image at an arbitrary position in space by using a pair of transducers (hereinafter, it is assumed that for example, speakers are used as the transducers) disposed apart from each other.

Figure 17:
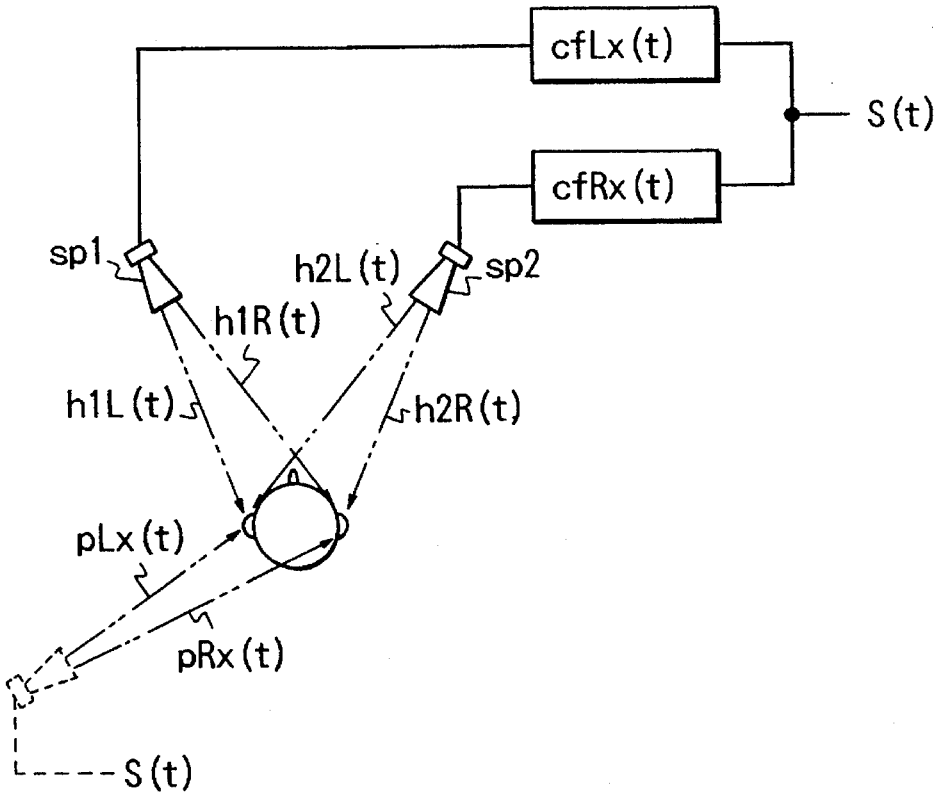
FIG. 17 is a schematic block diagram for illustrating the fundamental principle of sound image localization.

FIG. 17 is a schematic block diagram for illustrating the fundamental principle of the method employed in the embodiments of the present invention. In this figure, reference characters sp1 and sp2 denote speakers disposed leftwardly and rightwardly in front of a listener, respectively. Here, let h1L(t), h1R(t), h2L(t) and h2R(t) designate the head-related transfer characteristics (namely, the impulse response) between the speaker sp1 and the left ear of the listener, those between the speaker sp1 and the right ear of the listener, those between the speaker sp2 and the left ear of the listener and those between the speaker sp2 and the right ear of the listener, respectively. Further, let pLx(t) and pRx(t) designate the head-related transfer characteristics between a speaker placed actually at a desired location (hereunder sometimes referred to as a target location) x and the left ear of the listener and those between the speaker placed actually at the target location x and the right ear of the listener, respectively. Here, note that the transfer characteristics h1L(t), h1R(t), h2L(t) and h2R(t) are obtained by performing an appropriate waveform shaping processing on data actually measured by using a speaker and microphones disposed at the positions of the ears of the dummy head (or a human head) in acoustic space.

Next, it is considered how signals obtained through the signal conversion devices (namely, the convolvers), the transfer characteristics of which are cfLx(t) and cfRx(t), from the sound source s(t) to be localized should be reproduced by the speakers sp1 and sp2, respectively. Here, let eL(t) and eR(t) denote signals obtained at the left ear and the right ear of the listener, respectively. Further, the signals eL and eR are given by the following equations in time-domain representation:

$$eL(t)=h1L(t)*cfLx(t)*s(t)+h2L(t)*cfRx(t)*s(t) \quad (1a1)$$

$$eR(t)=h1R(t),*cfLx(t)*s(t)+h2R(t),*cfRx(t),*s(t) \quad (1a2)$$

(Incidentally, character * denotes a convolution operation). Further, the corresponding equations in frequency-domain representation are as follows:

$$EL(\omega)=H1L(\omega t)\cdot CfLx(\omega)\cdot S(\omega)+H2L(\omega)\cdot CfRx(\omega)\cdot S(\omega) \quad (1b1)$$

$$ER(\omega)=H1R(\omega t)\cdot CfLx(\omega)\cdot S(\omega)+H2R(\omega)\cdot CfRx(\omega)\cdot S(\omega) \quad (1b2)$$

On the other hand, let dL and dR denote signals obtained at the left ear and the right ear of the listener, respectively, when the sound source s(t) is placed at the target location. Further, the signals dL(t) and dR(t) are given by the following equations in time-domain representation:

$$dL(t)=pLx(t)*s(t) \quad (2a1)$$

$$dR(t)=pRx(t)*s(t) \quad (2a2)$$

Furthermore, the corresponding equations in frequency-domain representation are as follows:

$$DL(\omega)=PLx(\omega)\cdot S(\omega) \quad (2b1)$$

$$DR(\omega)=PRx(\omega)\cdot S(\omega) \quad (2b2)$$

If the signals, which are obtained at the left ear and the right ear of the listener when reproduced by the speakers sp1 and sp2, match the signals, which are obtained at the left ear and the right ear of the listener, respectively, when the sound source s(t) is placed at the target location (namely, eL(t)=dL(t) and eR(t)=dR(t), thus, EL(ω)=DL(ω) and ER(ω)=DR(ω)), the listener perceives a sound image as if the speakers are disposed at the target location. If S(ω) is eliminated from these equations and the equations (1b1), (1b2), (2b1) and (2b2), the transfer characteristics are obtained as follows:

$$CfLx(\omega)=\{H2R(\omega)\cdot PLx(\omega)-H2L(\omega)\cdot PRx(\omega)\}\cdot G(\omega) \quad (3a1)$$

$$CfRx(\omega)=\{-H1R(\omega)\cdot PLx(\omega)+H1L(\omega)\cdot PRx(\omega)\}\cdot G(\omega) \quad (3a2)$$

where $$G(\omega)=1/\{H1L(\omega)\cdot H2R(\omega)-H2L(\omega)\cdot H1R(\omega)\}$$

Further, the transfer characteristics in time-domain representation cfLx(t) and cfRx(t) are found as follows by performing inverse Fourier transforms on both sides of each of the equations (3*a*1) and (3*a*2):

$$cfLx(t)=\{h2R(t)*pLx(t)-h2L(t)*pRx(t)\}*g(t) \quad (3b1)$$

$$cfRx(t)=\{-h1R(t)*pLx(t)+h1L(t)*pRx(t)\}*g(t) \quad (3b2)$$

where g(t) is obtained by performing an inverse Fourier transform on G(ω).

Furthermore, the sound image can be located at the target position x by preparing a pair of localization filters for implementing the transfer characteristics CfLx(ω) and CfRx(ω) represented by the equations (3*a*1) and (3*a*2) or the time responses cfLx(t) and cfRx(t) represented by the equations (3*b*1) and (3*b*2) and then processing signals, which are issued from the sound source to be localized, by use of the convolvers (namely, the convolution operation circuits). Practically, various signal conversion devices can be implemented. For instance, the signal conversion devices may be implemented by using asymmetrical finite impulse response (FIR) digital filters (or convolvers). Incidentally, in case of this embodiment, as will be described later, the transfer characteristics realized by a pair of convolvers are made to be a time response (namely, an impulse response).

Namely, a sequence of coefficients (hereunder referred to simply as coefficients) are preliminarily prepared as data to be stored in a coefficient read-only memory (ROM), for the purpose of obtaining the transfer characteristics cfLx(t) and cfRx(t) when the sound source is located at the sound image location x, by performing a localization filtering only once. Thereafter, the coefficients needed for the sound image localization are transferred from the ROM to the pair of the localization filters whereupon a convolution operation is performed on signals sent from the sound source. Then, the sound image can be located at the desired given position by reproducing sounds from the signals obtained as the result of the convolution operation by use of the speakers.

Figure 18:
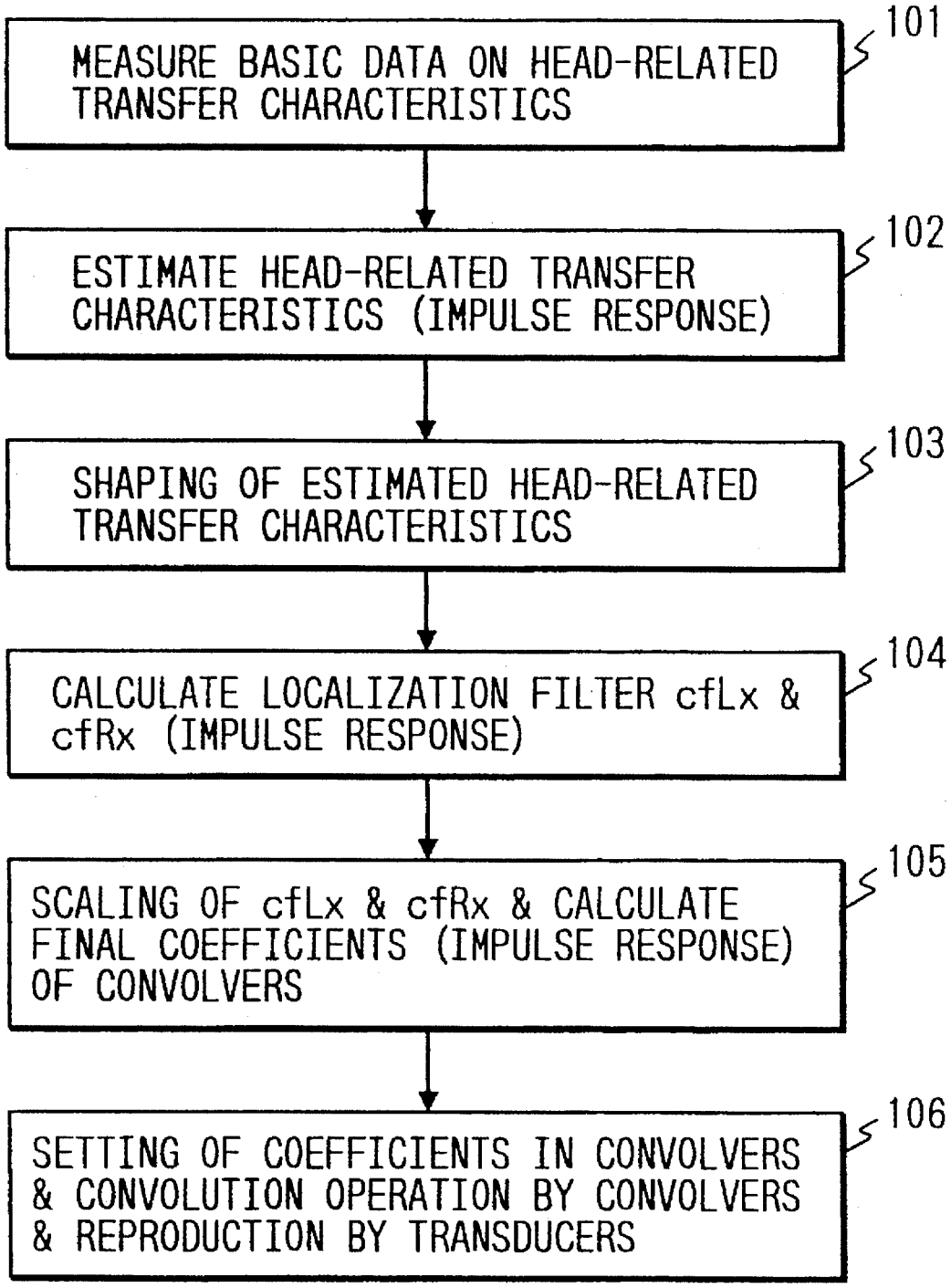
FIG. 18 is a flowchart for illustrating a sound image localization control method employed in a sound image localization control apparatus of the present invention.

This method for controlling the sound image localization, which is based on the principle explained heretofore, will be described in detail by referring to FIG. 18. Incidentally, FIG. 18 is a flowchart for illustrating steps of this method.

① Measurement of Basic Data on Head Related Transfer Characteristics (thus HRTF) (step 101)

Figure 19:
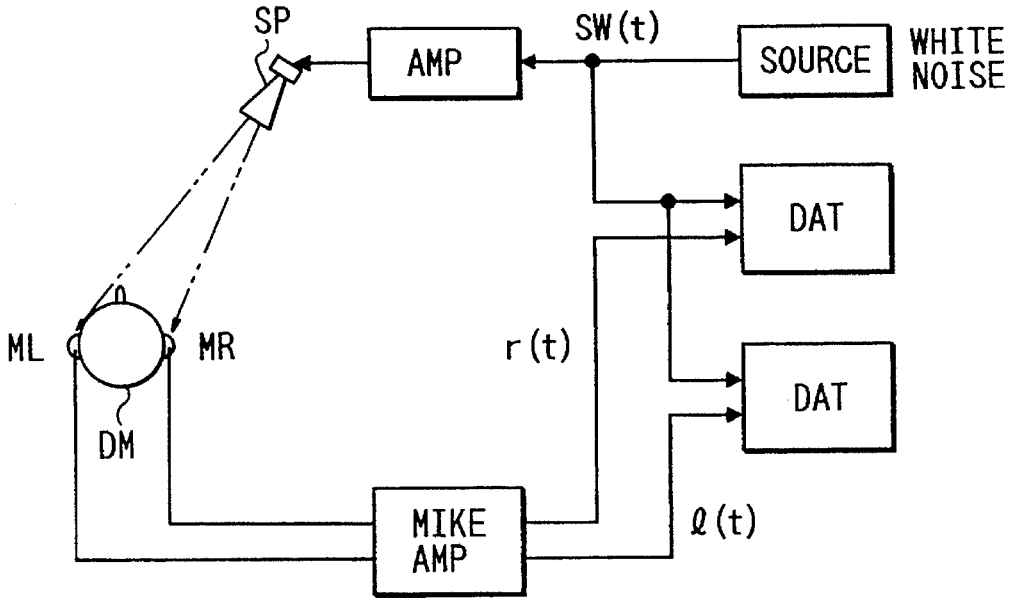
FIG. 19 is a schematic block diagram for illustrating the configuration of a system for measuring HRTF (thus, head-related transfer characteristics)

This will be explained by referring to FIGS. 19 and 20. FIG. 19 is a schematic block diagram for illustrating the configuration of a system for measuring basic data on the head-related transfer characteristics. As illustrated in this figure, a pair of microphones ML and MR are set at the positions of the ears of a dummy head (or a human head) DM. These microphones receive from the speakers sounds to be measured. Further, a source sound sw(t) (namely, reference data) and the sounds 1(t) and r(t) to be measured (namely, data to be measured) L and R are recorded by recorders DAT in synchronization with one another.

Incidentally, impulse sounds and noises such as a white noise may be used as the source sound sw(t). Especially, it is said from statistical point of view that a white noise is preferable for improving the signal-to-noise ratio (S/N) because of the facts that the white noise is a continuous sound and that the energy distribution of the white noise is constant over what is called an audio frequency band.

Figure 20:
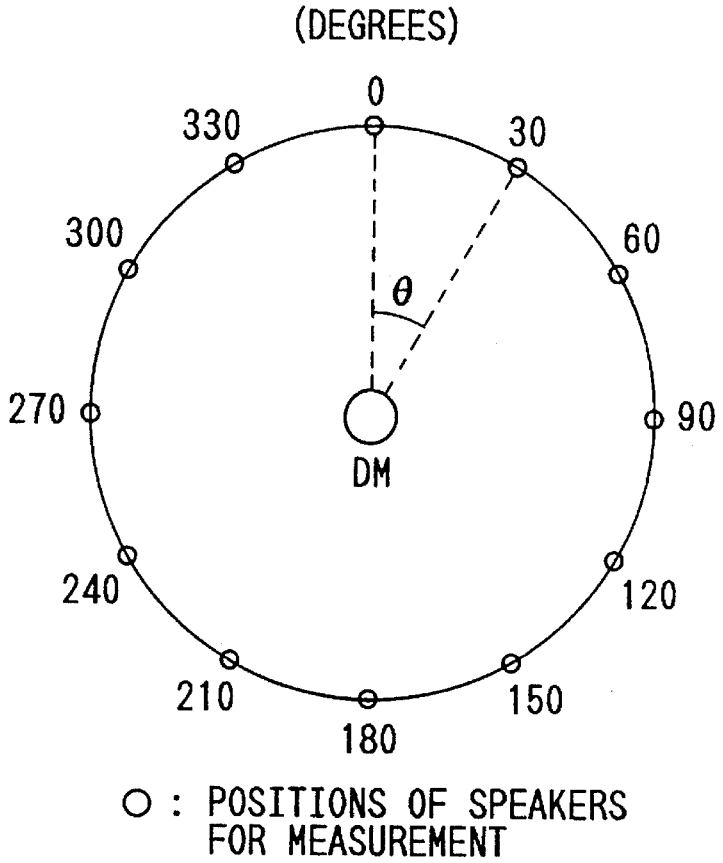
FIG. 20 is a diagram for illustrating positions at which HRTF is measured (thus, head-related transfer characteristics are measured)

Additionally, the speakers SP are placed at positions (hereunder sometimes referred to as measurement positions) corresponding to a plurality of central angles θ (incidentally, the position of the dummy head (or human head) is the center and the central angle corresponding to the just front of the dummy head is set to be 0 degree), for example, at 12 positions set every 30 degrees as illustrated in FIG. 20. Furthermore, the sounds radiated from these speakers are recorded continuously for a predetermined duration. Thus, basic data on the head related transfer characteristics are collected and measured.

② Estimation of Head Related Transfer Characteristics (Impulse Response) (step 102)

In this step, the source sound sw(t) (namely, the reference data) and the sounds 1(t) and r(t) to be measured (namely, the data to be measured) recorded in step 101 in synchronization with one another are processed by a workstation (not shown).

Here, let Sw(ω), Y(ω) and IR(ω) denote the source sound in frequency-domain representation (namely, the reference data), the sound to be measured, which is in frequency-domain representation, (namely, the data to be measured) and the head-related transfer characteristics in frequency-domain representation obtained at the measurement positions, respectively. Further, the relation among input and output data is represented by the following equation:

$$Y(\omega)=IR(\omega)\cdot sw(\omega) \tag{4}$$

Thus, IR(ω) is obtained as follows:

$$IR(\omega)=Y(\omega)/\ Sw(\omega) \tag{5}$$

Thus, the reference data sw(t) and the measured data 1(t) and r(t) obtained in step 101 are extracted as the reference data Sw(ω) and the measured data Y(ω) by using synchronized windows and performing FFT thereon to expand the extracted data into finite Fourier series with respect to discrete frequencies. Finally, the head related transfer characteristics IR(ω) composed of a pair of left and right transfer characteristics corresponding to each sound image location are calculated and estimated from the equation (5).

In this manner, the head related transfer characteristics respectively corresponding to 12 positions set every 30 degrees as illustrated in, for example, FIG. 20, are obtained. Incidentally, hereinafter, the head related transfer characteristics composed of a pair of left and right transfer characteristics will be referred to simply as head related transfer characteristics (namely, an impulse response). Further, the left and right transfer characteristics will not be referred to individually. Moreover, the head related transfer characteristics in time-domain representation will be denoted by ir(t) and those in frequency-domain representation will be denoted by IR(ω).

Further, the time-base response (namely, the impulse response) ir(t) (namely, a first impulse response) is obtained by performing an inverse FFT on the computed frequency responses IR(ω).

Incidentally, where the head related transfer characteristics are estimated in this way, it is preferable for improving the precision of IR(ω) (namely, improving S/N) to compute the frequency responses IR(ω) respectively corresponding to hundreds of windows which are different in time from one another, and to then average the computed frequency responses IR(ω).

③ Shaping of Head Related Transfer Characteristics (Impulse Response) ir(t) (step 103)

In this step, the impulse response ir(t) obtained in step 102 is shaped. First, the first impulse response ir(t) obtained in step 102 is expanded with respect to discrete frequencies by performing FFT over what is called an audio spectrum.

Thus, the frequency response IR(ω) is obtained. Moreover, components of an unnecessary band (for instance, large dips may occur in a high frequency band but such a band are unnecessary for the sound image localization) is eliminated from the frequency response IR(ω) by a band-pass filter (BPF) which has the passband of 50 hertz (Hz) to 16 kilo-hertz (kHz). As the result of such a band limitation, unnecessary peaks and dips existing on the frequency axis or base are removed. Thus, coefficients unnecessary for the localization filters are not generated. Consequently, the convergency can be improved and the number of coefficients of the localization filter can be reduced.

Then, an inverse FFT is performed on the band-limited IR(ω) to obtain the impulse response ir(t). Subsequently, what is called a window processing is performed on ir(t) (namely, the impulse response) on the time base or axis by using an extraction window (for instance, a window represented by a cosine function). (Thus, a second impulse response ir(t) is obtained.) As the result of the window processing, only an effective portion of the impulse response can be extracted and thus the length (namely, the region of support) thereof becomes short. Consequently, the convergency of the localization filter becomes improved. Moreover, the sound quality does not become deteriorated.

Incidentally, it is not always necessary to generate the first impulse response ir(t). Namely, the FFT transform and the inverse FFT transform to be performed before the generation of the first impulse response ir(t) is effected may be omitted. However, the first impulse response ir(t) can be utilized for monitoring and can be reserved as the proto-type of the coefficients. For example, the effects of the BPF can be confirmed on the time axis by comparing the first impulse response ir(t) with the second impulse response ir(t). Moreover, it can be also confirmed whether the filtering performed according to the coefficients does not converge but oscillates. Furthermore, the first impulse response ir(t) can be preserved as basic transfer characteristics to be used for obtaining the head related transfer characteristics at the intermediate position by computation instead of actual observation.

④ Calculation of Transfer Characteristics cfLx(t) and cfRx(t) of Localization Filters (step 104)

The time-domain transfer characteristics cfLx(t) and cfRx(t) of the pair of the localization filters, which are necessary for localizing a sound image at a target position x, are given by the equations (3*b*1) and (3*b*2) as above described. Namely, $$cfLx(t)=\{h2R(t)*pLx(t)-h2L(t)*pRx(t)\}*g(t) \quad (3b1)$$

$$cfRx(t)=\{-h1R(t)*pLx(t)+h1L(t)*pRx(t)\}*g(t) \quad (3b2)$$

where g(t) is an inverse Fourier transform of $G(\omega)=1/\{H1L(\omega)\cdot H2R(\omega)-H2L(\omega)\cdot H1R(\omega)\}$.

Figure 21:
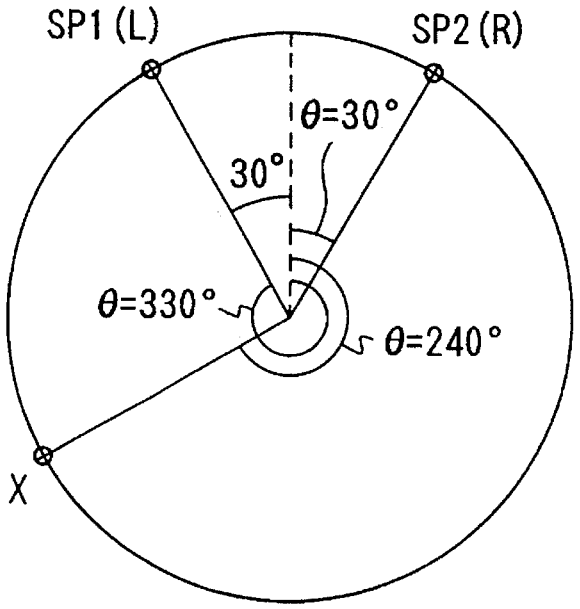
FIG. 21 is a diagram for illustrating calculation of coefficients of localization filters (to be described later).

Here, it is supposed that the speakers sp1 and sp2 are placed in the directions corresponding to azimuth angles of 30 degrees leftwardly and rightwardly from the very front of the dummy head (corresponding to θ=330 degrees and θ=30 degrees, respectively) as illustrated in FIG. 21 (namely, 30 degrees counterclockwise and clockwise from the central vertical radius indicated by a dashed line, as viewed in this figure) and that the target positions corresponding to θ are set every 30 degrees as shown in FIG. 20. Hereinafter, it will be described how the transfer characteristics cfLx(t) and cfRx(t) of the localization filters are obtained from the head related transfer characteristics composed of the pair of the left and right transfer characteristics, namely, the pair of the left and right second impulse responses (ir(t)), which are obtained in steps 101 to 103 correspondingly to angles θ and are shaped.

Firstly, the second impulse response ir(t) corresponding to θ=330 degrees is substituted for the head-related transfer characteristics h1L(t) and h1R(t) of the equations (3b1) and (3b2). Further, the second impulse response ir(t) corresponding to θ=30 degrees is substituted for the head-related transfer characteristics h2L(t) and h2R(t) of the equations (3b1) and (3b2). Moreover, the second impulse response ir(t) corresponding to the target localization position x is substituted for the head-related transfer characteristics pLx(t) and pRx(t) of the equations (3b1) and (3b2).

On the other hand, the function g(t) of time t is an inverse Fourier transform of G(ω) which is a kind of an inverse filter of the term $\{H1L(\omega)\cdot H2R(\omega)-H2L(\omega)\cdot H1R(\omega)\}$. Further, the function g(t) does not depend on the target sound image position or location x but depends on the positions (namely, θ=330 degrees and θ=30 degrees) at which the speakers sp1 and sp2 are placed. This time-dependent function g(t) can be relatively easily obtained from the head-related transfer characteristics h1L(t), h1R(t), h2L(t) and h2R(t) by using a method of least squares. This respect is described in detail in, for instance, the article entitled "Inverse filter design program based on least square criterion", Journal of Acoustical Society of Japan, 43[4], pp. 267 to 276, 1987.

The time-dependent function g(t) obtained by using the method of least squares as above described is substituted for the equations (3b1) and (3b2). Then, the pair of the transfer characteristics cfLx(t) and cfRx(t) for localizing a sound image at each sound image location are obtained not adaptively but uniquely as a time-base or time-domain impulse response by performing the convolution operations according to the equations (3b1) and (3b2). Furthermore, the coefficients (namely, the sequence of the coefficients) are used as the coefficient data.

As described above, the transfer characteristics cfLx(t) and cfRx(t) of an entire space (360 degrees) are obtained correspondingly to the target sound image locations or positions established every 30 degrees over a wide space (namely, the entire space), the corresponding azimuth angles of which are within the range from the very front of the dummy head to 90 degrees clockwise and anticlockwise (incidentally, the desired location of the sound image is included in such a range) and may be beyond such a range. Incidentally, hereinafter, it is assumed that the characters cfLx(t) and cfRx(t) designate the transfer characteristics (namely, the impulse response) of the localization filters, as well as the coefficients (namely, the sequence of the coefficients).

As is apparent from the equations (3b1) and (3b2), it is very important for reducing the number of the coefficients (namely, the number of taps) of the localization filters (the corresponding transfer characteristics cfLx(t) and cfRx(t)) to "shorten" (namely, reduce what is called the effective length of) the head-related transfer characteristics h1L(t), h1R(t), h2L(t), h2R(t), pRx(t) and pLx(t). For this purpose, various processing (for instance, a window processing and a shaping processing) is effected in steps 101 to 103, as described above, to "shorten" the head-related transfer characteristics (namely, the impulse response) ir(t) to be substituted for h1L(t), . . . , and h2R(t).

Further, the transfer characteristics (namely, the coefficients) of the localization filters may be obtained by performing FFT on the transfer characteristics (namely, the coefficients) cfLx(t) and cfRx(t) calculated as described above to find the frequency response, and then performing a moving average processing on the frequency response using a constant predetermined shifting width and finally effecting an inverse FFT of the result of the moving average processing. The unnecessary peaks and dips can be removed as the result of the moving average processing. Thus, the convergence of the time response to be realized can be quickened and the size of the cancellation filter can be reduced.

⑤ Scaling of Coefficients of Localization Filters Corresponding to Each Sound Image Location (step 105)

One of the spectral distributions of the source sounds of the sound source, on which the sound image localization processing is actually effected by using the convolvers (namely, the cancellation filters), is like that of a pink noise. In case of another spectral distribution of the source sounds, the intensity level gradually decreases in a high (namely, long) length region. In any case, the source sound of the sound source is different from single tone. Therefore, when the convolution operation (or integration) is effected, an overflow may occur. As the result, a distortion in signal may occur.

Thus, to prevent an occurrence of an overflow, the coefficient having a maximum gain is first detected among the coefficients cfLx(t) and cfRx(t) of the localization filters. Then, the scaling of all of the coefficients is effected in such a manner that no overflow occurs when the convolution of the coefficient having the maximum gain and a white noise of 0 dB is performed.

Namely, the sum of squares of each set of the coefficients cfLx(t) and cfRx(t) of the localization filters is first obtained. Then, the localization filter having a maximum sum of the squares of each set of the coefficients thereof is found. Further, the scaling of the coefficients is performed such that no overflow occurs in the found localization filter having the maximum sum. Incidentally, a same scaling ratio is used for the scaling of the coefficients of all of the localization filters in order not to lose the balance of the localization filters corresponding to sound image locations, respectively.

As the result of performing the scaling processing in this way, coefficient data (namely, data on the groups of the coefficients of the impulse response) to be finally supplied to the localization filters (namely, convolvers to be described later) as the coefficients (namely, the sequence of the coefficients) are obtained. In case of this example, 12 sets or groups of the coefficients cfLx(t) and cfRx(t), by which the sound image can be localized at the positions set at angular intervals of 30 degrees, are obtained.

⑥ Convolution Operation And Reproduction of Sound Signal Obtained from Sound Source (step 106)

Namely, a time-base convolution operation is performed on the signals sent from the sound source s(t). Then, the signals obtained as the result of the convolution operation are reproduced from the spaced-apart speakers sp1 and sp2.

Next, the first embodiment of the present invention, which is based on the fundamental principle described hereinabove, will be described hereinbelow.

Figure 1:
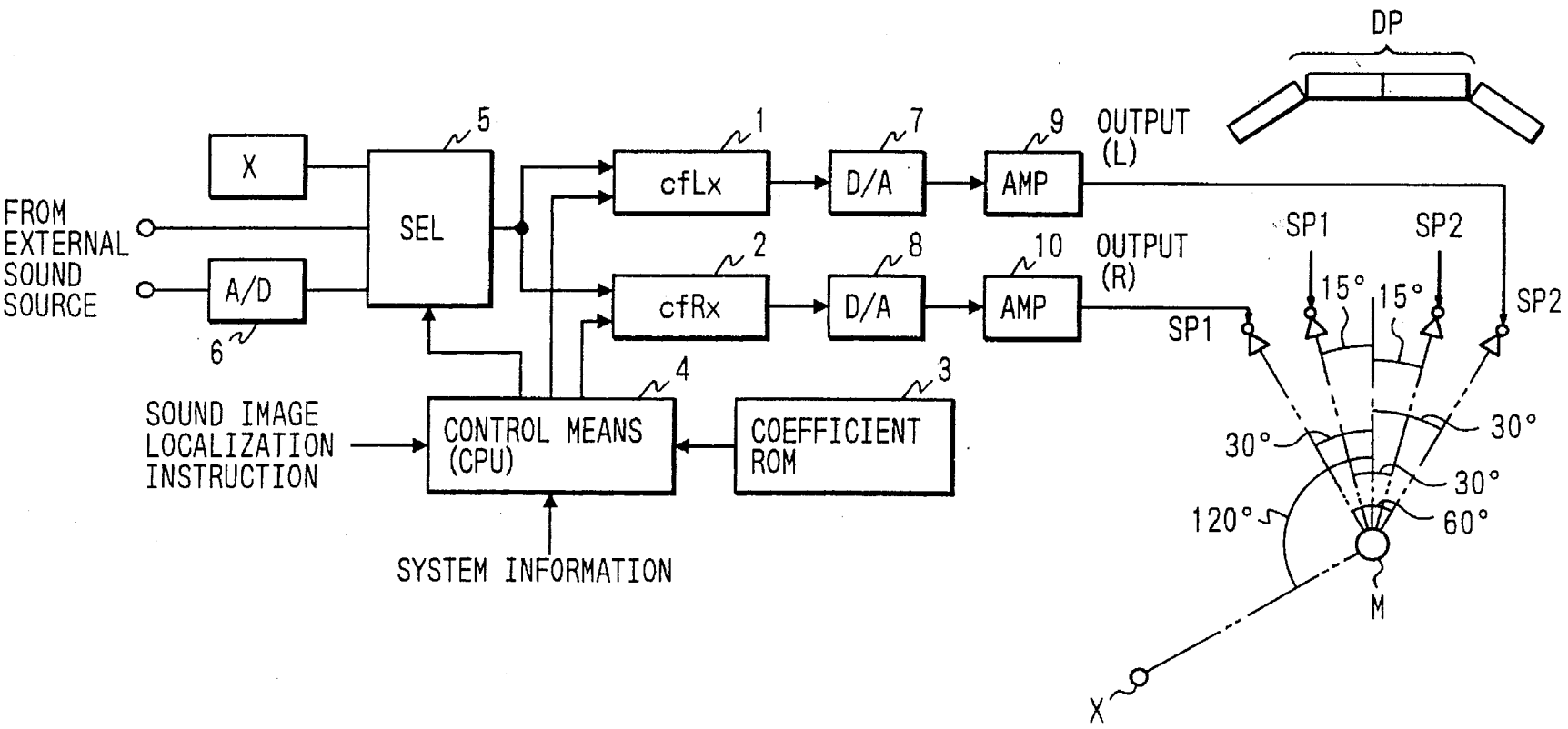
FIG. 1 is a schematic block diagram for illustrating the configuration of a first embodiment of the present invention (namely, the basic configuration of a sound image localization control apparatus according to the present invention)

FIG. 1 is a schematic block diagram for illustrating the configuration of the first embodiment of the present invention (namely, the configuration of a sound image localization control apparatus according to the present invention).

As shown in this figure, the sound image localization control apparatus is provided with a pair of convolvers (namely, convolution operation circuits (incidentally, refer to the second embodiment to be described later) 1 and 2 for performing a time-base convolution operation on signals sent from a sound source; a coefficient ROM 3 for storing coefficients cfLx and cfRx of 12 pairs of convolvers established every 30 degrees, which coefficients are calculated as the result of performing the process from step 101 to step 105 (namely, ① to ⑤); and a control means (namely, a coefficient supply means (practically, this control means is implemented by a central processing unit (CPU))) 4 for transferring coefficients corresponding to a desired sound image location from the coefficient ROM 3 to the pairs of the convolvers 1 and 2 according to a sound image localization instruction.

Further, in case of this sound image localization control apparatus, a convolution operation is performed on signals sent from a same sound source (namely, a common sound source) by the pairs of the convolvers 1 and 2. Further, the signals are reproduced from a pair of speakers sp1 and sp2 disposed apart from each other in such a manner that an unfolding angle (namely, an opening angle) determined by two segments drawn from the listener (namely, a common point or vertex) to the speakers sp1 and sp2, respectively, is a predetermined angle. The coefficients of the convolvers are calculated on the basis of this predetermined opening angle. In case of this embodiment, the azimuth angles of these speakers are 30 degrees anticlockwise and clockwise from the very front of the listener, respectively. Thus, this opening angle is 60 degrees, as illustrated in FIG. 18.

Further, digital signals sent from a sound source (for example, a synthesizer for use in a game machine) X (corresonding to s(t)) are input to the convolvers 1 and 2 through a selector (namely, a sound-source selecting means) 5. Incidentally, in case of analog signals sent from the sound source, digital signals obtained as a result of performing an analog-to-digital (A/D) conversion on the analog signals by an A/D converter 6 are input thereto. Then, a convolution operation is performed on the input digital signal by the convolvers 1 and 2. Subsequently, resultant signals are converted by digital-to-analog (D/A) converters 7 and 8 into analog signals which are further amplified by amplifiers 9 and 10. The amplified signals are reproduced from the pair of the speakers sp1 and sp2.

In case of this sound image localization control system or apparatus, according to a sound image localization instruction issued from a host CPU of a game machine or the like (namely, an instruction indicating a selected sound source and a sound image location (for instance, an instruction instructing the system to issue sounds of an air plane from the location corresponding to an azimuth angle of 120 degrees (namely, the location corresponding to θ=240 degrees), signals sent from the sound source X are selected by the control means 4 through the selector 5 and the coefficients cfLx and cfRx corresponding to the sound image location (for instance, corresponding to θ=240 degrees) are read from the ROM 3 and supplied to and set in the convolvers 1 and 2.

The convolvers 1 and 2 perform convolution operations on the signals which represent sounds of the air plane and are sent from the same sound source X. Then, the signals obtained as the result of the convolution operation are reproduced from the spaced-apart speakers sp1 and sp2. Thus, the crosstalk perceived by the ears of the listener is cancelled from the sounds reproduced from the pair of the speakers sp1 and sp2. As a consequence, the listener (for example, an operator of a game machine) M hears the reproduced sounds as if the sound source were localized at the desired position (for instance, corresponding to an azimuth angle of 120 degrees). Consequently, extremely realistic sounds are reproduced.

Further, in case of the game machine, the coefficients of the convolvers 1 and 2 are changed on demand in accordance with a sound image localization instruction issued from the host CPU in such a fashion to correspond to the motion of the air plane, which motion is realized in response to the manipulation effected by the operator M. Moreover, when the sounds of the air plane should be replaced with those of a missile, the source sound to be issued from the sound source X is changed from the sound of the air plane to that of the missile by the selector 5.

In this manner, in accordance with the sound image localization control apparatus of the present invention, a sound image of a desired kind can be localized at a given position. Thus, in case where an image (or video) reproducing apparatus (for example, the image reproducing apparatus DP consisting of 4 displays arranged in a fan-shaped position, as illustrated in FIG. 1) is provided in front of the operator and sounds, as well as an image to be displayed on the screen of the display of the game machine, are reproduced, the image and sounds are changed in response to manipulations effected by the operator M. As the result, there can be realized an amusement game machine which can provide extremely realistic presence.

Further, the unfolding or opening angle (namely, the angle sp1-M-sp2 of FIG. 1) is an angle, on the basis of which the coefficients of the convolvers are calculated. In case of this embodiment, the coefficients needed when the speakers sp1 and sp2 are disposed in the directions corresponding to the counterclockwise and clockwise azimuth angles of 30 degrees from the very front of the listener, namely, when the unfolding angle is 60 degrees. In addition, another unfolding angle, for example, 30 degrees (namely, the speakers sp1 and sp2 are disposed in the directions corresponding to the counterclockwise and clockwise azimuth angles of 15 degrees from the very front of the listener) may be employed in the apparatus or system. In this case, in the ROM 3, 12 groups of the coefficients corresponding to the unfolding or opening angle of 30 degrees, as well as 12 groups of the coefficients corresponding to the unfolding or opening angle of 60 degrees, are preliminarily stored in the ROM 3. Further, system information representing the established states of the speakers is inputted to the control means 4 to select the groups of the coefficients corresponding to the actual reproducing system.

Furthermore, the coefficients of the convolvers vary with the conditions of the measurement of the HRTF (or the head related transfer characteristics). This may be taken into consideration. Namely, there is a difference in size of a head among persons. Thus, when measuring the basic data on the HRTF (or the head related transfer characteristics) in step 101, several kinds of the basic data may be measured by using the dummy heads (or human heads) of various sizes such that the coefficients (namely, the coefficients suitable for an adult having a large head and those suitable for a child having a small head) can be selectively used according to the listener. In this case, the system information also representing the state of the listener is inputted to the control means 4 to automatically select the coefficients corresponding to the actual state of the listener.

Hereinafter, other preferred embodiments (namely, the second to thirteenth embodiments) of the present invention, which are modifications of the first embodiment, will be described in detail. In the following description of the second to thirteenth embodiments of the present invention, like reference characters designate like or corresponding parts of the first embodiment. Further, for the simplicity of the description, the explanation of such common parts will be omitted. Moreover, in the figures showing the second to thirteenth embodiments of the present invention, the pair of the speakers sp1 and sp2 disposed in front of the listener M are omitted and only the primary parts of the second to thirteenth embodiments of the present invention are shown.

Figure 2:
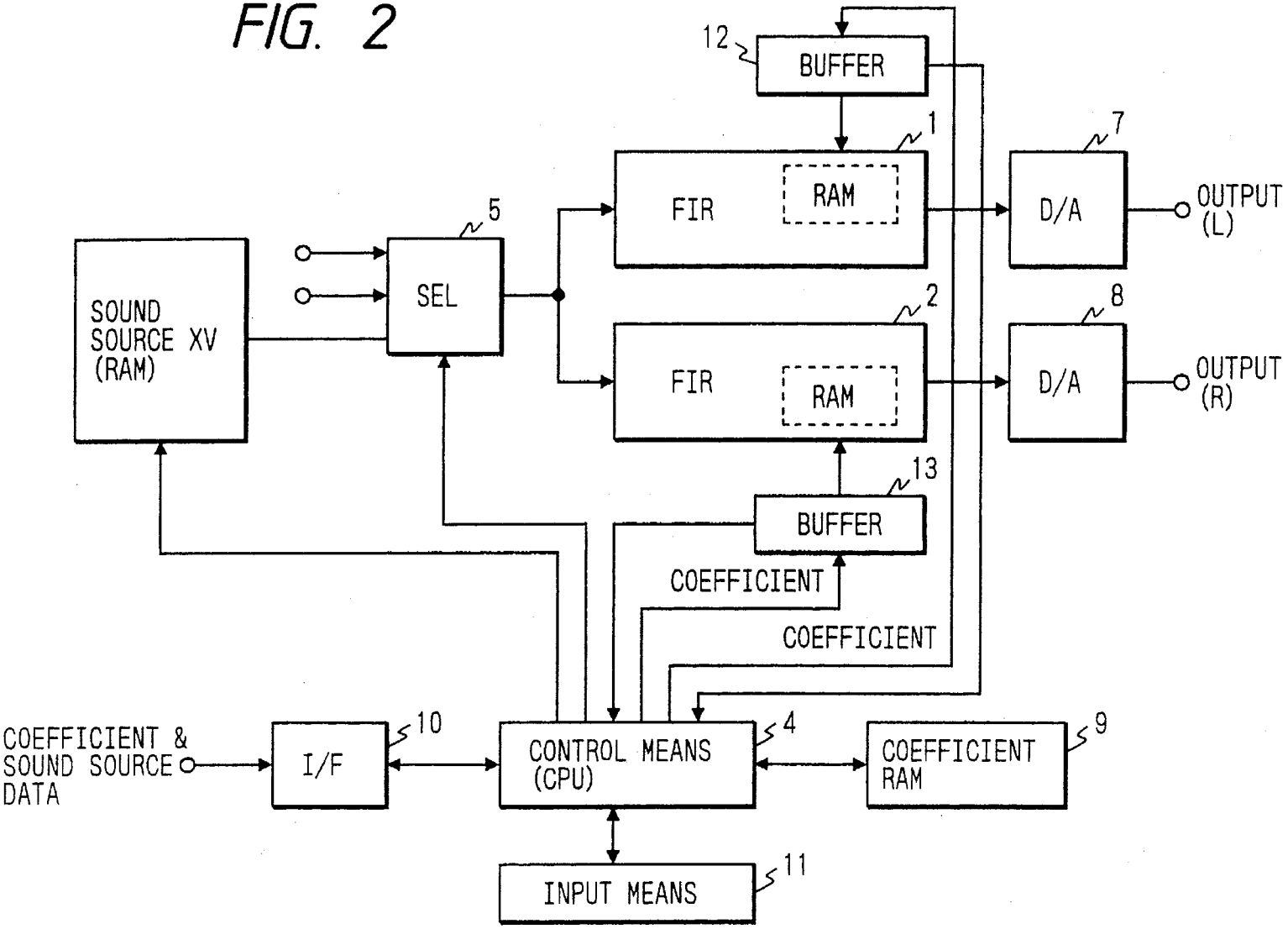
FIG. 2 is a schematic block diagram for illustrating the configuration of a modification of the first embodiment of the present invention (namely, a second embodiment of the present invention)

FIG. 2 is a schematic block diagram for illustrating the configuration of the second embodiment of the present invention.

In case of this embodiment of the present invention, data concerning the sound source (hereunder referred to as sound source data) and the coefficients are transferred to a random access memory (RAM) provided in the sound image localization control apparatus (namely, the second embodiment). Further, a sound image localization is effected by using the group of the coefficients which are selected from the groups of the coefficients as most suitable for the localization according to the system configuration of the sound image localization control apparatus and a device (not shown) for the estimation of the apparatus.

In this figure, reference numeral 9 designates a RAM for storing the coefficients cfLx and cfRx of the convolvers, which are loaded from the exterior of the apparatus through an interface 10. Further, reference numeral 11 denotes an input means consisting of a joy stick or the like for inputting information (or data) which designates a desired sound image location and a sound source. Furthermore, data for a sound source is inputted from the exterior through the interface 10 to the sound source XV (corresponding to s(t) (for example, a pulse code modulation (PCM) sound source for reproducing PCM sound data)). Incidentally, the groups of the coefficients of the convolvers and the data for the sound source are loaded from an external computer or an external storage device such as a compact disk read-only memory (CD-ROM).

On the other hand, the data representing the desired sound image location, the sound source and so on are inputted to the control means 4 from the input means 11 (or through the interface 10 from the external device), by which the inputted data is stored as a sequence of procedures and are processed. The control means 4 selects the sound source in accordance with the inputted procedure and supplies data representing the selected sound source to the convolvers 1 and 2. Further, the control means 4 reads from the RAM 9 the coefficients corresponding to the desired sound image location and sets the read coefficients in the convolvers 1 and 2.

Further, the practical configuration of each of the convolvers 1 and 2 will be described hereinbelow. Namely, the convolvers 1 and 2 are implemented by using, for example, digital signal processor (DSP) or the like as filters of the asymmetrical finite impulse response (FIR) type in which a RAM for storing convolution operation coefficients. The coefficients supplied by the control means 4 are temporarily stored in the buffers 12 and 13. Then, the coefficients stored therein are read by the convolvers 1 and 2. The control means 4 confirms from signals received from the buffers 12 and 13 that the coefficients stored in the buffers 12 and 13 are read by the convolvers 1 and 2. Subsequently, the control means 4 writes the next group of the coefficients to the buffers 12 and 13. Thus, the control means 4 can perform efficiently not only the operation of supplying the coefficients but also other operations by utilizing the buffers 12 and 13.

Incidentally, in case where the coefficients of the convolvers 1 and 2 are "long" (namely, the number of the coefficients thereof is large) and it is necessary to change the group of the coefficients in a moment, two RAMs for storing the convolution operation coefficients may be provided in each of the convolvers 12 and 13 to change banks (en bloc). Alternatively, two groups each having two buffers 12 and 13 may be provided and these groups may be used alternately.

Thus, in case of the sound image localization control apparatus (namely, the second embodiment of the present invention) constructed as above constructed, the coefficients of the convolvers are loaded from the exterior into the coefficient RAM 9 differently from the first embodiment in which the coefficient groups of the convolvers are stored in the ROM fixedly. Therefore, in case of the second embodiment, the coefficients of the convolvers can be changed easily. Namely, the coefficients cfLx and cfRx of the convolvers calculated by effecting the steps as above described in ① to ⑤ are inputted to the apparatus and then an image sound localization is performed actually. As a consequence, the obtained coefficients of the convolvers can be evaluated easily.

Further, a large number of groups of the coefficients, which groups vary with the system configuration (for instance, the arrangement of the speakers, the state of the speaker and so on), may be prepared and stored in a mass or bulk storage. In such a case, a sound image localization can be performed by loading the most suitable group of the coefficients into the apparatus. Moreover, the change of the coefficients, which is required due to a version-up of the system, can be achieved easily.

Figure 3:
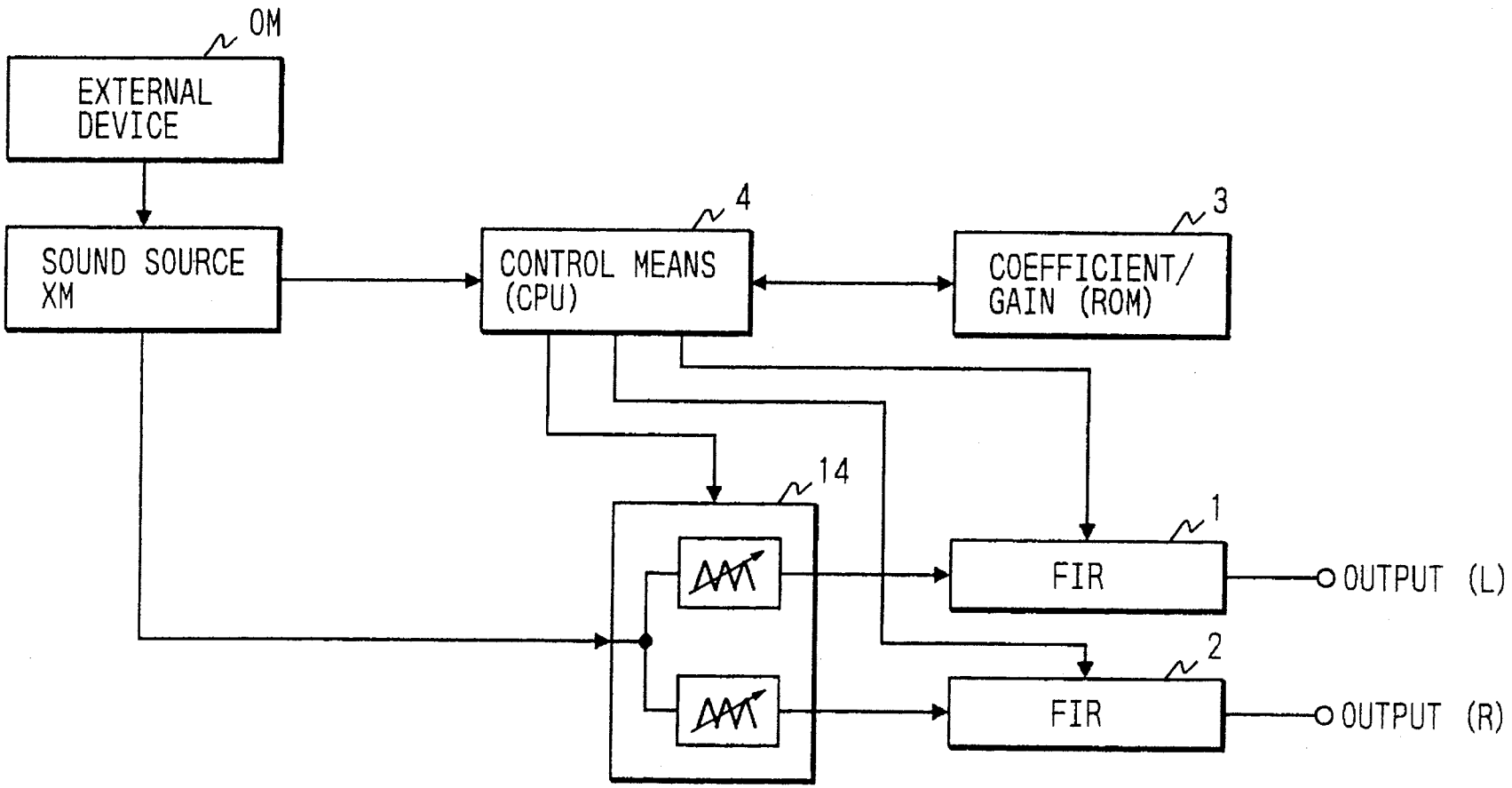
FIG. 3 is a schematic block diagram for illustrating the configuration of another modification of the first embodiment of the present invention (namely, a third embodiment of the present invention)

FIG. 3 is a schematic block diagram for illustrating the configuration of the third embodiment of the present invention.

In case of this embodiment, the gain of a signal sent from the sound source is first controlled and subsequently, the signal is supplied to the convolvers. Further, this embodiment is devised to prevent an occurrence of an overflow in a processing signal and to control the distance between sound images.

In this figure, a sound source XM (corresponding to s(t)) issues an audio signal according to, for instance, a musical instrument digital interface (MIDI) signal. Further, sound source control data and sound image localization data are fed to the sound source XM to an external device OM as MIDI data. The sound source XM not only issues audio signals according to demodulated sound source control data but also outputs the MIDI data to the control means 4 without changing the MIDI data. Then, the control means 4 demodulates a sound image localization instruction based on the sound image localization data and also demodulates a sound source level (to be described later) from the MIDI data.

Moreover, a gain control means (namely, a gain regulation means (for example, a variable attenuator)) 14 intervenes between the sound source XM and the convolvers 1 and 2. The control means 4 sets the coefficients in the convolvers in accordance with an sound image localization instruction sent from the sound source XM similarly as in case of the first and second embodiments. Furthermore, the control means 4 controls the gain control means 14 to regulate the gain of the signal according to the sound source level. The gain control can be achieved correspondingly to each pair of the convolvers 1 and 2 (which correspond to the left and right speakers, respectively).

In case where the level (namely, the sound source level) of an output of the selected sound source is high in this embodiment constructed as above described, an occurrence of an overflow can be prevented at the time of performing a convolution operation by supplying a signal received from the sound source, the level of which signal is lowered. Thus the degradation in sound quality can be prevented. At that time, the levels of the coefficients and the gain values (namely, the values of the gain), which is predetermined as adapted to changes in the level, are preliminarily stored together with the coefficients in the coefficient ROM. Thus the precise gain control may be effected according to the stored levels, gain values and coefficients.

Further, the distance between sound images can be controlled by regulating the gain by using the gain control means 14. Namely, if a sound image should be localized near the listener, the gain should be increased. In contrast, if a sound image should be localized far from the listener, the gain should be decreased. Moreover, the presence can be further increased by effecting the gain control by designating the distance between the sound image locations together with the kind of the sound source and the angular positions of the sound images (namely, the azimuth angles of the sound image locations) by the sound image localization instruction. At that time, the values of the gain, which vary with the azimuth angles of the sound image locations, and the coefficients of the convolvers are preliminarily measured (or prepared) and stored in the coefficient ROM. Thus, the distance between the sound image locations may be controlled with high precision by utilizing the gain values and the coefficients stored in the coefficient Furthermore, the gain control means 14 may cause the levels of signals, which are supplied to the convolvers 1 and 2, differ from each other to delicately control the sound image localization, the sound image locations, the width therebetween or the like.

Figure 4A:
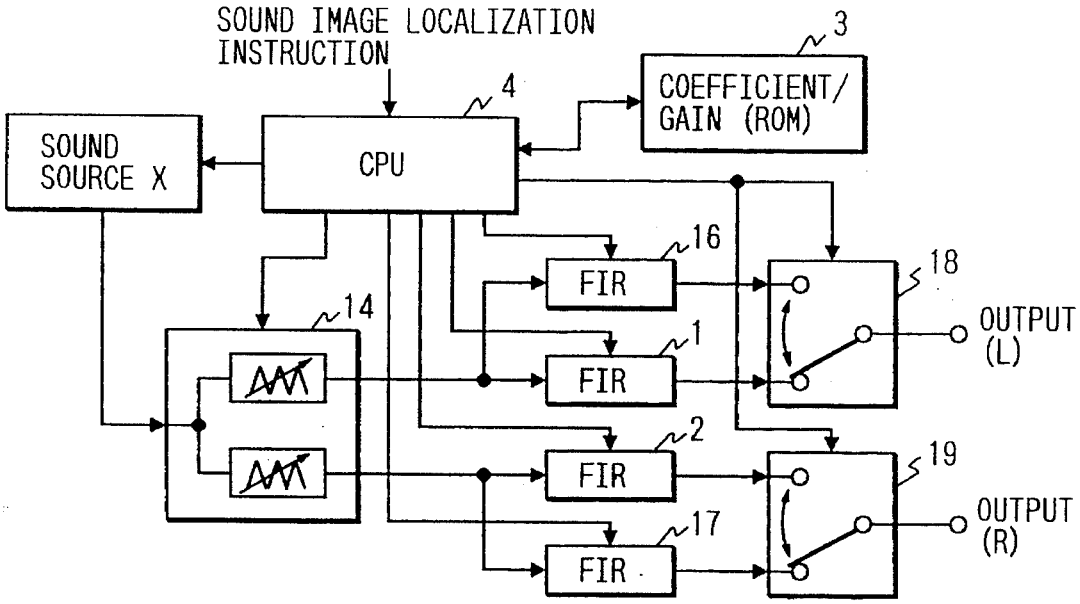
FIG. 4(A) is a schematic block diagram for illustrating the configuration of a fourth embodiment of the present invention.
Figure 4B:
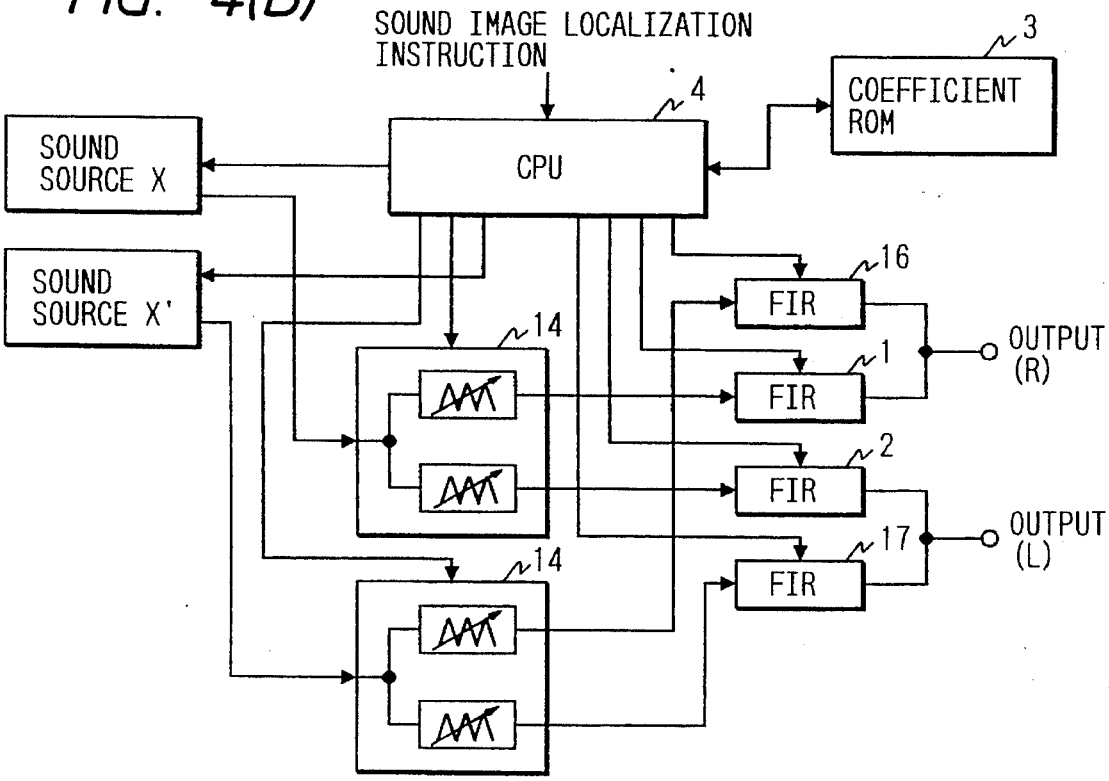
FIG. 4(B) is a schematic block diagram for illustrating the configuration of a modification of the fourth embodiment of the present invention.

FIGS. 4(A) and 4(B) are schematic block diagrams illustrating the configuration of the fourth embodiment of the present invention and that of a modification thereof, respectively.

The fourth embodiment is provided with a plurality of pairs of the convolvers. This embodiment is suited to cases where a sound image location should be changed in an instant and where a plurality of sound images are localized at different positions simultaneously.

As shown in FIG. 4(A), this sound image localization control apparatus is provided with first convolvers 1 and 2 and second convolvers 16 and 17 as pairs of the convolvers. Further, outputs of the selectors 18 and 19 are changed between an output of each of the first convolvers 1 and 2 and that of each of the second convolvers 16 and 17 in an interlocking manner. The output (L) of the selector 18 and that (R) of the selector 19 correspond to left and right speakers (not shown) and are reproduced by the left and right speakers, respectively.

Further, the coefficients of two sets corresponding to the different (two) sound image locations, respectively, are supplied by the control means 4 to a pair of the first convolvers 1 and 2 and another pair of the second convolvers 16 and 17, respectively (namely, a set of the coefficients corresponding to a sound image location are supplied to the first convolvers and another set thereof corresponding to another sound image location are fed to the second convolvers). Moreover, at the time of changing the outputs, the control means 4 controls the selectors 18 and 19 and as the result, the output of each of the selectors 18 and 19 is changed between the output of each of the first convolvers 1 and 2 and that of each of the second convolvers 16 and 17. Thus the sound image location can be changed instantly even if the coefficients of the convolvers 1 and 2 are "long" (namely, the numbers of the coefficients of the convolvers 1 and 2 are large).

Furthermore, as shown in FIG. 4(B), two kinds of signals sent from different sound sources X and X', respectively, may be supplied to a couple of the first convolvers 1 and 2 and another couple of the second convolvers 18 and 17, respectively. Then, outputs (L) and (R) representing results of convolution operations on the supplied signals may be mixed with each other and reproduced by the pair of the speakers (not shown). Thereby, two sound images can be localized at two different positions, simultaneously.

Incidentally, the listener's impression of the result of the sound image localization may be changed by supplying the signals sent from different sound sources X and X' to the couple of the first convolvers 1 and 2 and that of the second convolvers 16 and 17, respectively, after the gain of each of the signals is controlled.

Figure 5:
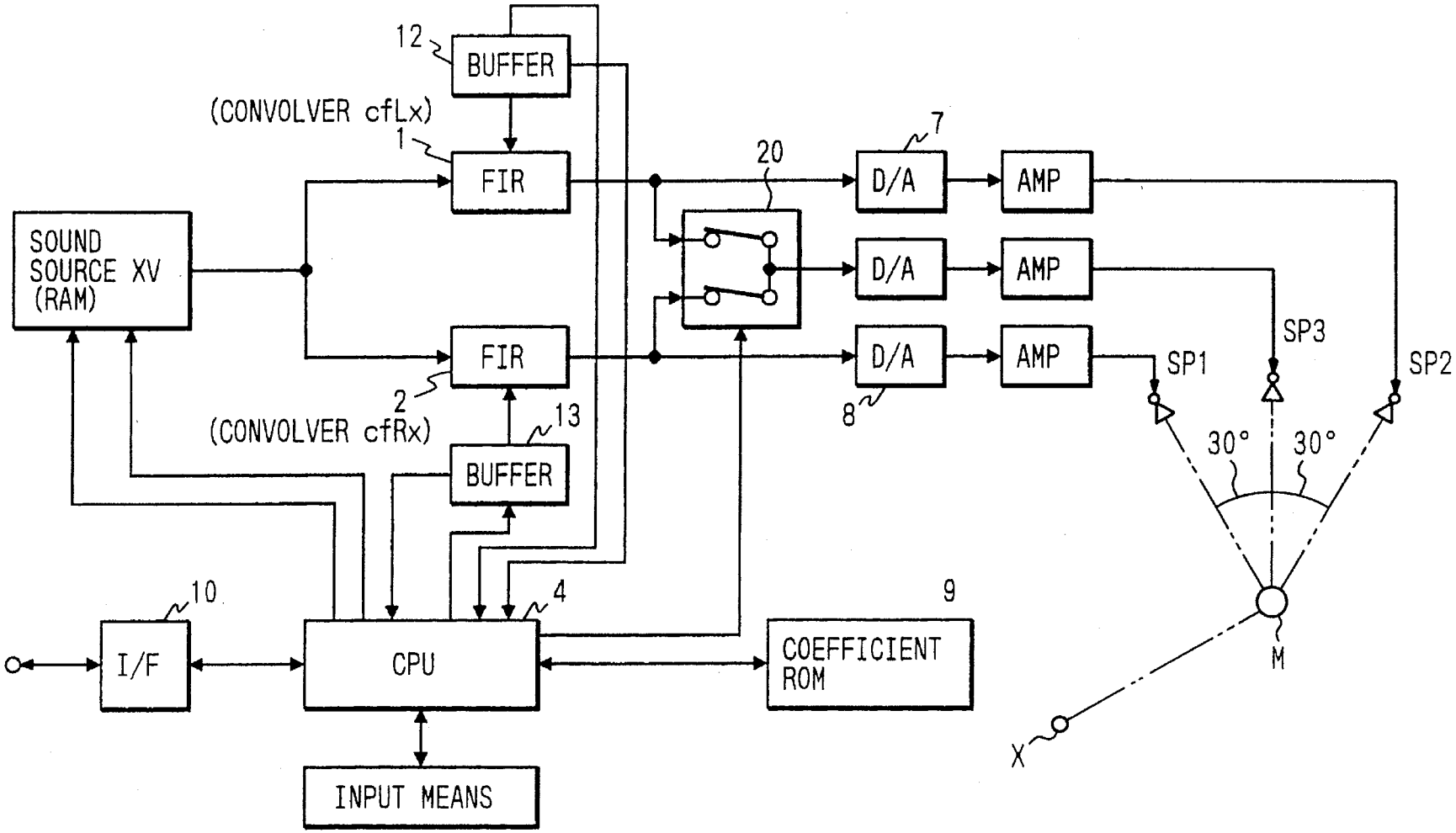
FIG. 5 is a schematic block diagram for illustrating the configuration of a fifth embodiment of the present invention.

FIG. 5 is a schematic block diagram for illustrating the configuration of the fifth embodiment of the present invention.

This embodiment is provided with an auxiliary speaker for reproducing signals obtained by adding up outputs of the convolvers 1 and 2, thereby localizing a sound image in front of the listener clearly.

As shown in this figure, in case of this sound image localization control apparatus, the outputs of the pair of the convolvers 1 and 2 are added by an addition switch 20 and then an output (namely, the result of the addition) of the addition switch 20 is reproduced by the auxiliary speaker sp3 placed between the pair of the speakers sp1 and sp2 (namely, in front of the listener).

The result of the addition is supplied through the addition switch 20 to this speaker. Further, the switch 20 is turned on and turned off by the control means 4. Namely, the switch 20 is ordinarily turned off. When a sound image is located in front of the listener or near the front of the listener, the switch 20 is turned on and thus an output thereof representing the result of the addition of the outputs of the convolvers 1 and 2 is reproduced from the speaker sp3.

Thus, when a sound image is localized in front of the listener or near the front of the listener, a reproduction signal is outputted from the auxiliary speaker sp3 disposed in front of the listener. Therefore, sounds reproduced correspondingly to sound image locations in front of and near the front of the listener does not lack. Consequently, a sound image can be clearly localized in front of the listener. Further, a range, in which the listener can feel the presence of a sound image, can be enlarged.

In contrast with the configuration of FIG. 5, the auxiliary speaker sp3 may be placed at the rear of the listener. Further, the addition switch 20 may be turned on when the sound image location is the rear of the listener and near the rear of the listener, thereby reproducing the result of the addition of outputs of the pair of the convolvers 1 and 2 from the auxiliary speaker sp3.

Additionally, the auxiliary speaker sp3 may be adapted to reproduce only sounds of low frequency range.

Incidentally, an attenuator may be substituted for the switch 20. Thereby, the volume of sounds reproduced from the auxiliary speaker sp3 and an addition ratio in accordance with which the outputs of the convolvers may be controlled in addition to the turning-on or turning-off of the reproduction from the speaker sp3.

Figure 6:
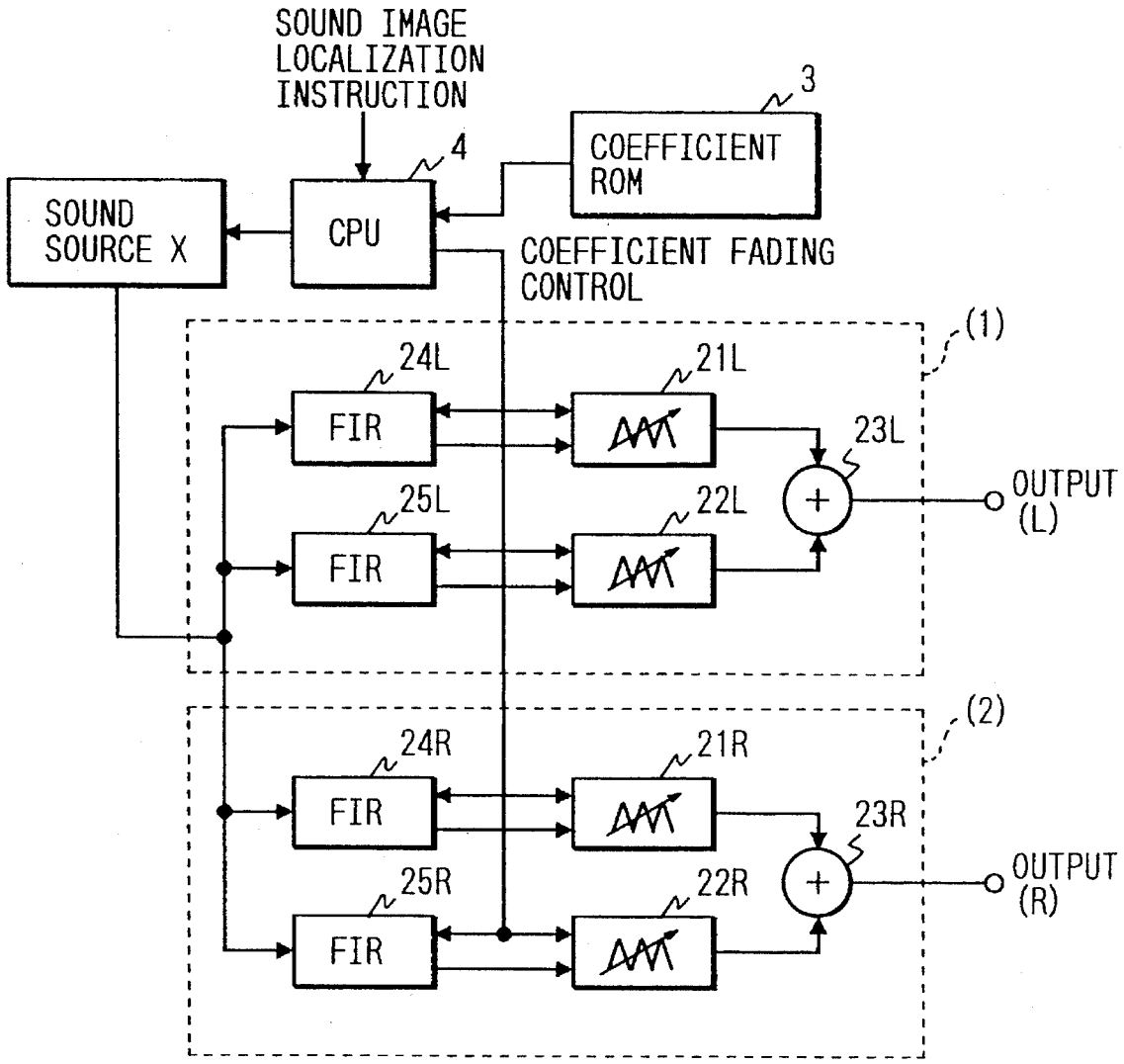
FIG. 6 is a schematic block diagram for illustrating the configuration of a sixth embodiment of the present invention.

FIG. 6 is a schematic block diagram for illustrating the configuration of the sixth embodiment of the present invention.

This embodiment has a pair of convolvers corresponding to a left speaker and another pair of convolvers corresponding to a right speaker. Further, what is called a cross fading processing is performed on an output of each of the pairs of convolvers. Moreover, this embodiment is suited for changing discrete sound image locations successively and for preventing the generation of noises which are liable to occur at the time of changing the coefficients.

As shown in this figure, this sound image localization control apparatus is provided with two pairs of the convolvers, namely, the first convolvers 24R and 24L and the second convolvers 25R and 25L as the pairs of the convolvers. Namely, differently from the first embodiment in which a pair of the convolvers 1 and 2 corresponding to the left and right speakers, respectively, are provided, the sixth embodiment has a first pair of the convolvers 24L and 25L corresponding to the left speaker and a second pair of the convolvers 24R and 25R corresponding to the right speaker.

Moreover, the coefficients of two sets corresponding to different two sound image locations are written to two couples of the convolvers (namely, a first couple of the convolvers 24R and 24L and a second couple of the convolvers 25R and 25L), respectively. Furthermore, convolution operations are effected in the convolvers which are connected to a same sound source X. Additionally, a cross fading means corresponding to an output (L) for the left speaker composed of faders (namely, variable attenuators) 21L and 22L and an addition means 23L. Similarly, a cross fading means corresponding to an output (R) for the right speaker composed of faders (namely, variable attenuators) 21R and 22R and an addition means 23R.

Further, outputs of the convolvers 24R and 25R are inputted to the faders (namely, variable attenuators) 21R and 22R. On the other hand, outputs of the convolvers 24L and 25L are inputted to the faders (namely, variable attenuators) 21L and 22L. Furthermore, a cross fading processing is performed on the outputs of the convolvers 24R and 25R by the faders 21R and 22R and the addition means 23R. Further, a cross fading processing is also performed on the outputs of the convolvers 24L and 25L by the faders 21L and 22L and the addition means 23L. Finally, outputs (L, R) obtained as the result of the cross fading processing are reproduced from a pair of the speakers (not shown).

In case of the sound image localization control apparatus (namely, the sixth embodiment) having the above described structure, at the time of changing the sound image location (namely, at the time of changing the set of the coefficients), two sets of the coefficients corresponding to different sound image locations (namely, the coefficients used before the change and those to be used after the change) are supplied to the first couple of the convolvers 24R and 24L and the second couple of the convolvers 25R and 25L, respectively, by the control means 4 according to a sound image localization instruction. Thereafter, results of convolution operations corresponding to the sets of the coefficients are outputted to the faders 21R, 22R, 21L and 22L. Further, a cross fading processing is performed in accordance with a cross fading control signal sent from the control means 4 on the results of the convolution operations effected before and after the change of the sound image location. Then, signals obtained as the result of this cross fading processing are reproduced.

This respect will be described in detail hereinbelow. FIGS. 7(A) to 7(E) are diagrams for illustrating the cross fading processing to be performed in the sixth embodiment of the present invention. For example, a process will be described in a case where the apparatus now performs an operation of localizing a sound image at a location corresponding to an azimuth angle of 60 degrees and the apparatus next performs an operation of localizing a sound image at another location corresponding to an azimuth angle of 90 degrees. In such a case, one of the couples of the convolvers (for instance, the first couple of the convolvers 24R and 24L) are supplied with the coefficients corresponding to the azimuth angle of 60 degrees and are in action. In contrast, the other couple of the convolvers (namely, the second couple of the convolvers 25R and 25L) are not in action.

Figures 7A, 7B, 7C, 7D, 7E:
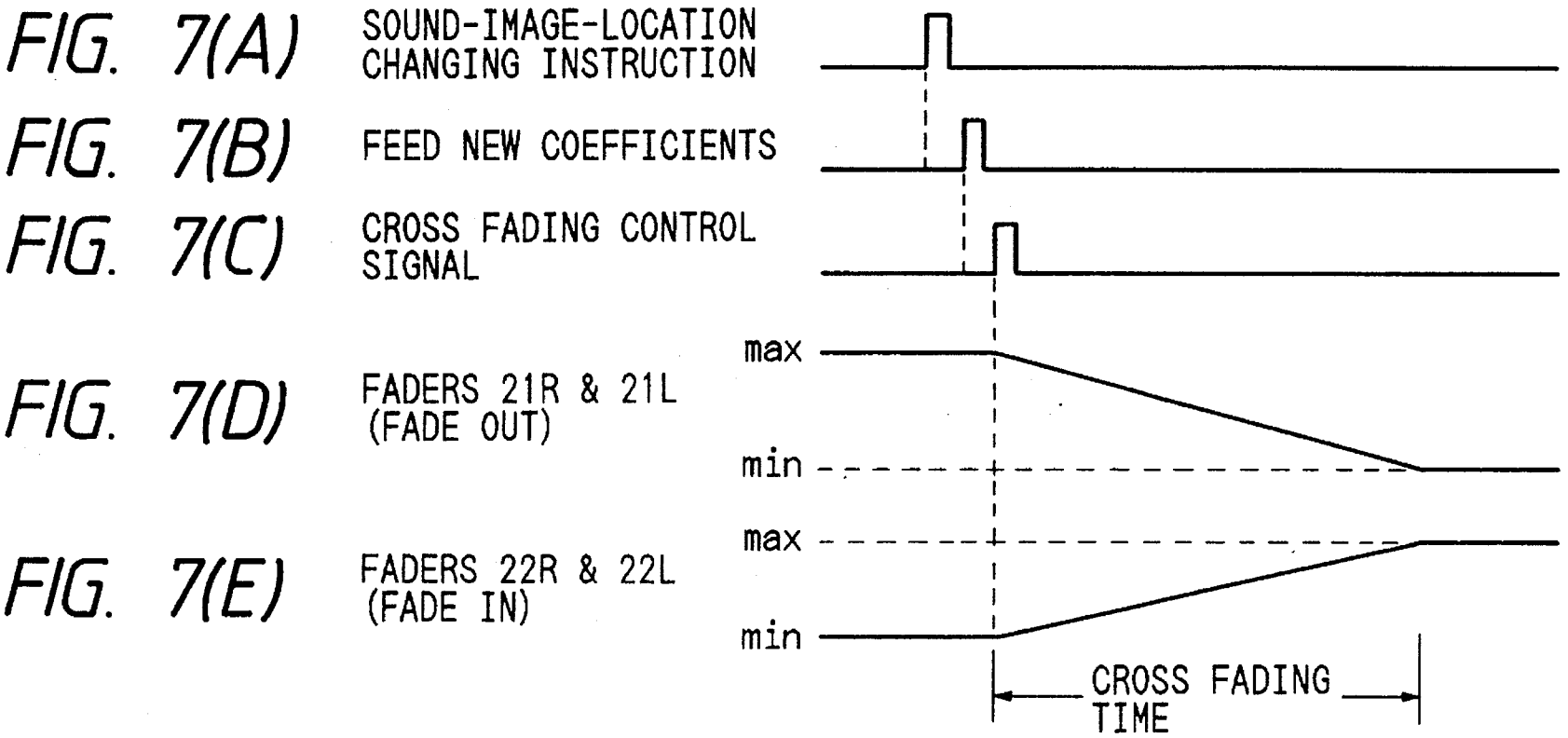
FIGS. 7(A) to 7(E) are diagrams for illustrating a cross fading processing to be performed in the sixth embodiment of the present invention.

If an instruction to change the sound image location from that corresponding to the azimuth angle of 60 degrees to that corresponding to the azimuth angle of 90 degrees is given to the control means 4 (see FIG. 7(A)) when the apparatus is in such a state, the control means 4 feeds the coefficients corresponding to the azimuth angle of 90 degrees to the second couple of the convolvers 25R and 25L (see FIG. 7(B)). Further, the control means 4 outputs a cross fading control signal to the faders 21R, 22R, 21L and 22L (see FIG. 7(C)).

Then, the faders 21R, 22R, 21L and 22L operate as illustrated in FIGS. 7(D) and 7(E) in response to the cross fading control signal. As the result, outputs of the first couple of the convolvers 24R and 24L are faded out. In contrast, outputs of the second couple of the convolvers 25R and 25L are faded in. Thus, the convolvers to be used are changed from the first couple of the convolvers 24R and 24L to the second couple of the convolvers 25R and 25L, performing a cross fading. If such a change is effected for a period of tens of milli-seconds (ms) by performing a cross fading, the sound image location (thus, the coefficients) can be changed without occurrences of what are called changing noises.

For the purpose of controlling a duration when the cross fading is effected, the control means may output a signal representing a most suitable duration of the cross fading together with the cross fading control signal. Thereby, the sound image location can be changed successively among discrete positions (for example, the location corresponding to the azimuth angle of 60 degrees and the location corresponding to the azimuth angle of 90 degrees).

Figure 8:
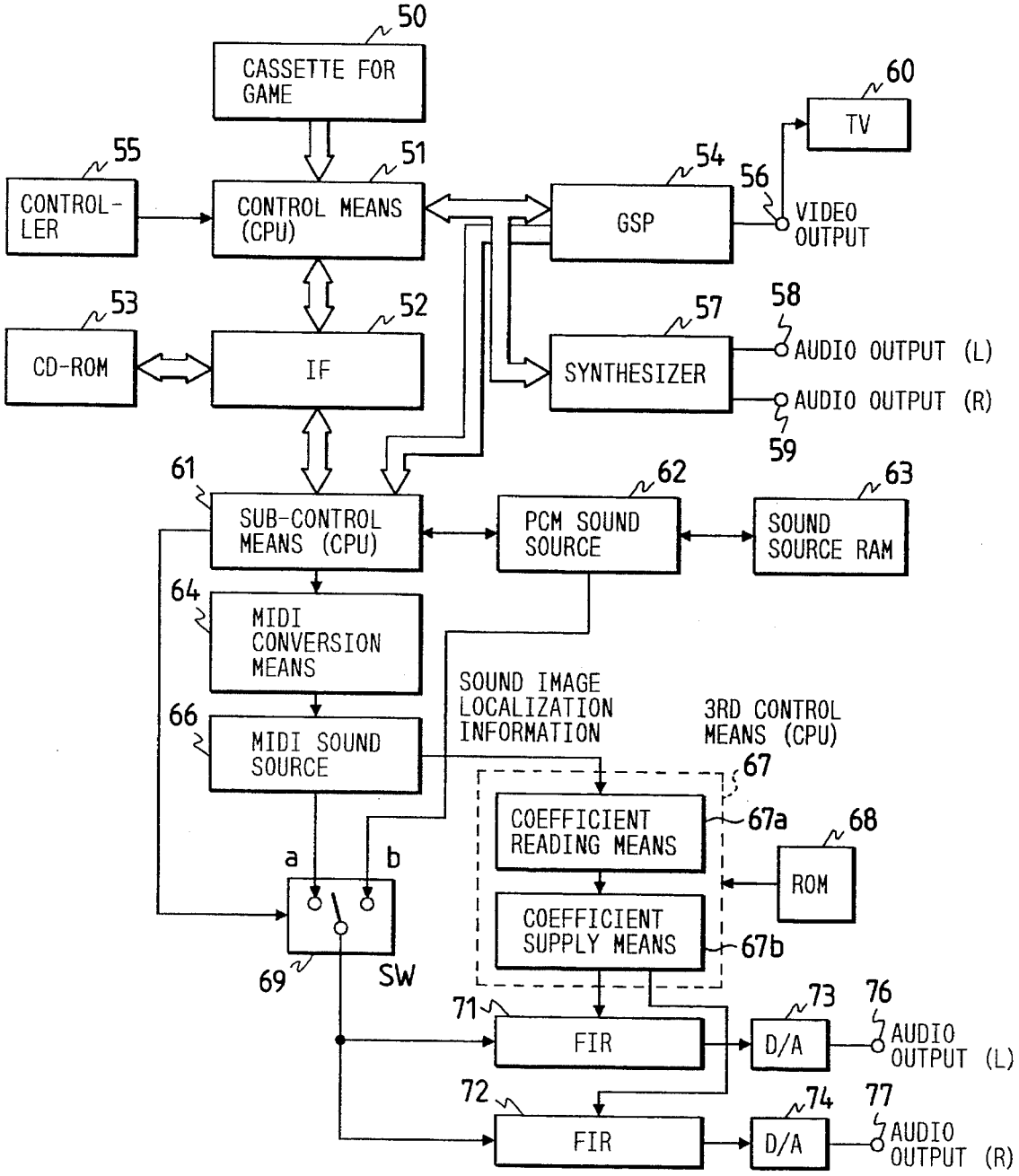
FIG. 8 is a schematic block diagram for illustrating the configuration of a seventh embodiment of the present invention.

FIG. 8 is a schematic block diagram for illustrating the configuration of the seventh embodiment of the present invention.

In case of this embodiment, a sound image localization is performed in synchronization with a moving picture reproduced on a monitor (display).

In this figure, reference numeral 51 designates a (main) control means (CPU) connected to a controller 51 for controlling the control means 50 and a cassette 50 for a game through a data bus. In the cassette 50, video display data, audio data and sound image location data are recorded in such a manner to have a predetermined relation.

Moreover, an interface (IF) unit (hereunder referred to simply as an interface) 52, a graphic system processor (GSP) 54 for realizing a desired graphic image and a synthesizer 57 are connected to the control means (CPU) 51 through data buses, respectively. Further, a CD-ROM 53 is connected to the interface 52. Similarly to the cassette 50, video display data, audio data and sound image location data are recorded in the CD-ROM 53 in such a way to have a predetermined relation.

Moreover, a monitor display 60 is connected to the graphic system processor 54 through a video output terminal 56. Reference numerals 58 and 59 are terminals outputting left and right audio signals from the synthesizer 57, respectively.

Furthermore, the interface 52 and the graphic system processor 54 are connected to a sub-control means or unit (SUB-CPU) 61 through data buses. Additionally, a PCM sound source 62 is connected to this sub-control means through a data bus. Further, a sound source RAM 63 is connected to the PCM sound source 62. The sound source RAM 63 is used to temporarily store data provided from the CD-ROM 53 because the amount of data provided therefrom is large. Incidentally, the sound source RAM 63 is controlled by the PCM sound source 62.

Further, reference numeral 64 denotes a MIDI conversion means (hereunder sometimes referred to simply as a MIDI converter) 64 for converting audio data supplied from the CD-ROM 53 into predetermined MIDI signals. The MIDI converter 64 is connected to a MIDI sound source 66 in the next stage. The MIDI sound source 66 is connected to an a terminal of a switch (SW) 69.

Moreover, an output of the PCM sound source 69 is connected to a b terminal of the switch 62. The switch 69 is controlled by the sub-control means 61.

Furthermore, reference numeral 67 designates a third control means provided with a coefficient reading means 67*a* and a coefficient supply means 67*b*. The coefficient reading means 67*a* is controlled according to sound image localization data supplied from the sub-control means 61 through the MIDI sound source 66.

Reference numeral 68 denotes a storing means (ROM) in which the twelve sets of the coefficients cfLx and cfRx of the convolvers established every 30 degrees, which coefficients are calculated as the result of performing the process from step 101 to step 105 (namely, ① to ⑤). Incidentally, in this case, the coefficients for localization may be regarded as being bisymmetrical and thus only the coefficients corresponding to the left or right speaker may be prepared.

Furthermore, an output of the coefficient reading means 67*a* is connected through the coefficient supply means 67*b* to the convolver 71 corresponding to the left speaker and the convolver 72 corresponding to the right speaker. Further, outputs of the convolvers 71 and 72 are connected to digital-to-analog (D/A) converters 73 and 74, respectively. Moreover, audio data corresponding to the left speaker (L) and audio data corresponding to the right speaker (R) are outputted from output terminals 76 and 77, respectively.

Next, an operation of the seventh embodiment constructed as described hereinabove will be described hereunder.

First, when the CD-ROM 53 is provided in the apparatus and the controller 55 is operated, video display data, audio data and sound image location data are supplied from the CD-ROM 53 to the sub control means 61 and an operating signal is also fed from the controller 55 thereto.

As the result, a designation signal for designating data used to create an image is supplied to the graphic system processor 54 whereupon image signals to be used to form a mosaic image consisting of a plurality of partial images are generated. Then, the image signals are outputted from the output terminal 56 to the monitor 60.

Figures 9A, 9B, 9C, 9D, 9E, 9F, 9G:
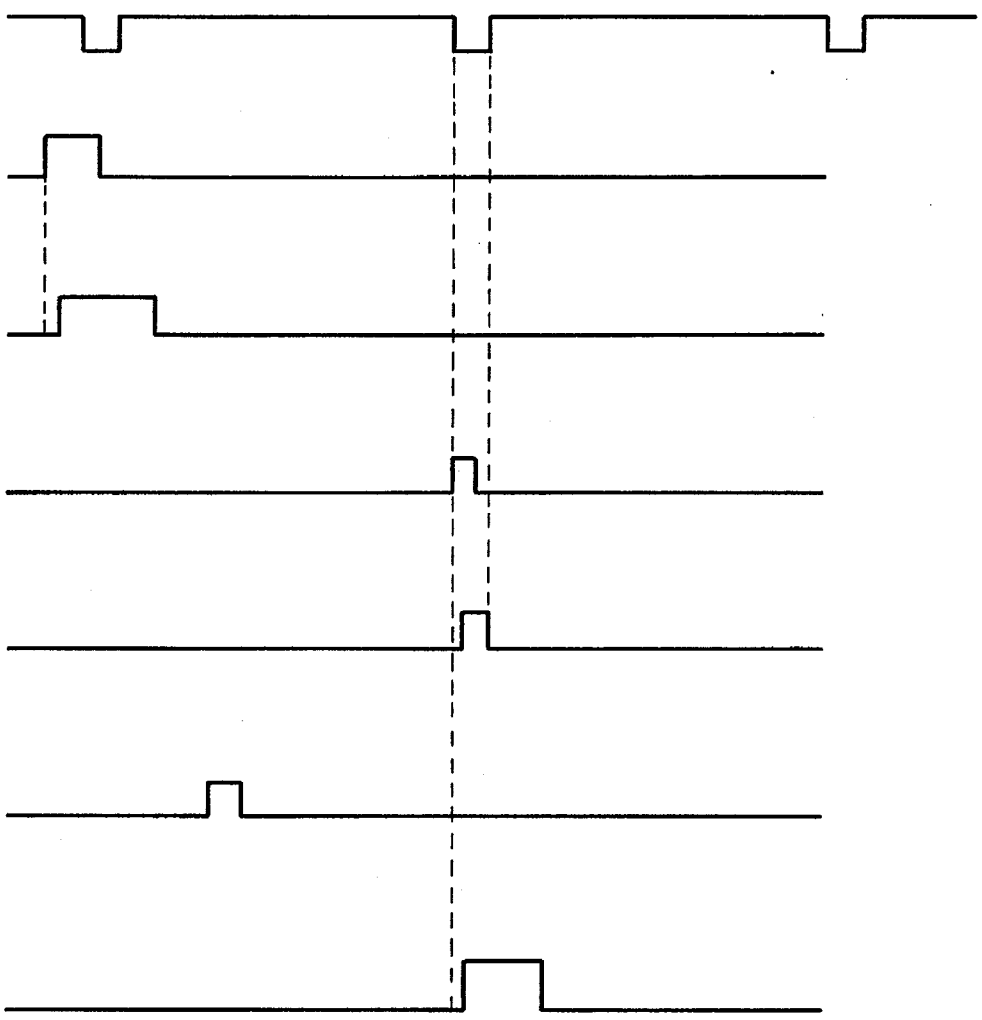
FIGS. 9(A) to 9(G) are diagrams for illustrating synchronization timing in the seventh embodiment of the present invention.

At that time, the graphic system processor 54 generates field or frame synchronization signals of FIG. 9(A) in synchronization with the image signal. The generated field or frame synchronization signal is fed to the sub-control means 61.

Moreover, the operating signals of FIG. 9(B) are supplied from the controller 55 through the control means 51 to the sub-control means 61. The operating signal is asynchronous with the field or frame synchronization signal in respect of time. Sound image localization is determined by the sub-control means 61 on the basis of the operating signal and the sound image location data received from the CD-ROM 53 in a period of time as illustrated in FIG. 9(C). Further, sound image localization data or information is supplied to the third control means 67 through the MIDI converter 64 and the MIDI sound source 66 in a blanking period of the field or frame synchronization signal on the basis of this determination.

The coefficient reading means 67*a* reads the predetermined coefficients corresponding to each block from the storage means 68 according to the sound image localization data at that time. These coefficients are fed from the coefficient supply means 67*b* to RAMs (not shown) of the convolvers 71 and 72, alternately, in accordance with the timing chart illustrated in FIG. 9(E) and the coefficients are changed by turns.

On the other hand, the switch 69 is set to the terminal a at that time according to the control signal issued from the sub-control means 61. The sub-control means 61 detects sound source data and audio conversion data from audio data. Then, such detected data (or information) is converted by the MIDI converter 64 into MIDI signals. Subsequently, a desired sound source is selected from the MIDI sound source 66 on the basis of the MIDI signal. Further, a monaural audio signal corresponding to the selected sound source is fed to the terminal a.

Each of the convolvers 71and 72 performs a time-base convolution operation on the audio signals by using the coefficients supplied from the coefficient supply means 67*b*. Then, outputs of the convolvers are converted by the D/A converters 73 and 74 into analog signals which are further outputted from the output terminal 78 and 77 to the speakers.

Thereby, the sound image localization is effected in synchronization with the motion of an image, which progresses in response to operations effected by the controller 55, in such a fashion to make the listener feel as if the sound sources were localized at desired specific positions which is different from the actual positions of the pair of the speakers. As a consequence, the listener hears sounds with extremely realistic presence.

Further, in case that the cassette 50 for a game is provided in the apparatus instead of the CD-ROM 53 for a game and the controller 55 is operated, an operating signal, video display data, audio data and sound image location data are supplied to the control means 51, similarly as in the former case. Then, the graphic system processor 54 generates image signals to be used to form a mosaic image according to the video display data and outputs the image signals to the monitor 60. Further, according to the audio data, the synthesizer 57 selects, for instance, a sound source for generating audio signal used to issue an effect sound. The audio signals sent from the selected sound source are added to audio signals outputted from the output terminals 76 and 77 after the sound image localization by an adder (not shown) and thereafter signals obtained as the result of the addition are outputted therefrom.

Moreover, similarly as in the former case, a synchronization signal is produced in the graphic system processor 54 together with the image signal. Then, the synchronization signal is supplied to the sub-control means 61.

On the other hand, the audio data and the sound image location data are fed to the sub-control means 61. Further, the audio data is fed to the PCM sound source 62. The PCM sound source 62 selects a sound source according to the audio data and causes the sound source RAM 63 of the next stage to store a signal outputted from the selected sound source at a predetermined location thereof temporarily. Thereafter, the PCM sound source 82 reads the signal stored in the sound source RAM 83 and feeds the read signal to the switch 89 as a monaural audio signal. In this case, the switch 89 is set to the terminal b. Furthermore, the sound image location data or information is supplied to the third control means 87 at the time as illustrated in FIG. 9(D). Thereafter, the predetermined coefficients are read from the ROM 68 according to this data or information and the read coefficients are fed to the convolvers 71 and 72 at the time as illustrated in FIG. 9(E). Then, convolution operations are performed on the audio signals therein.

Figure 10:
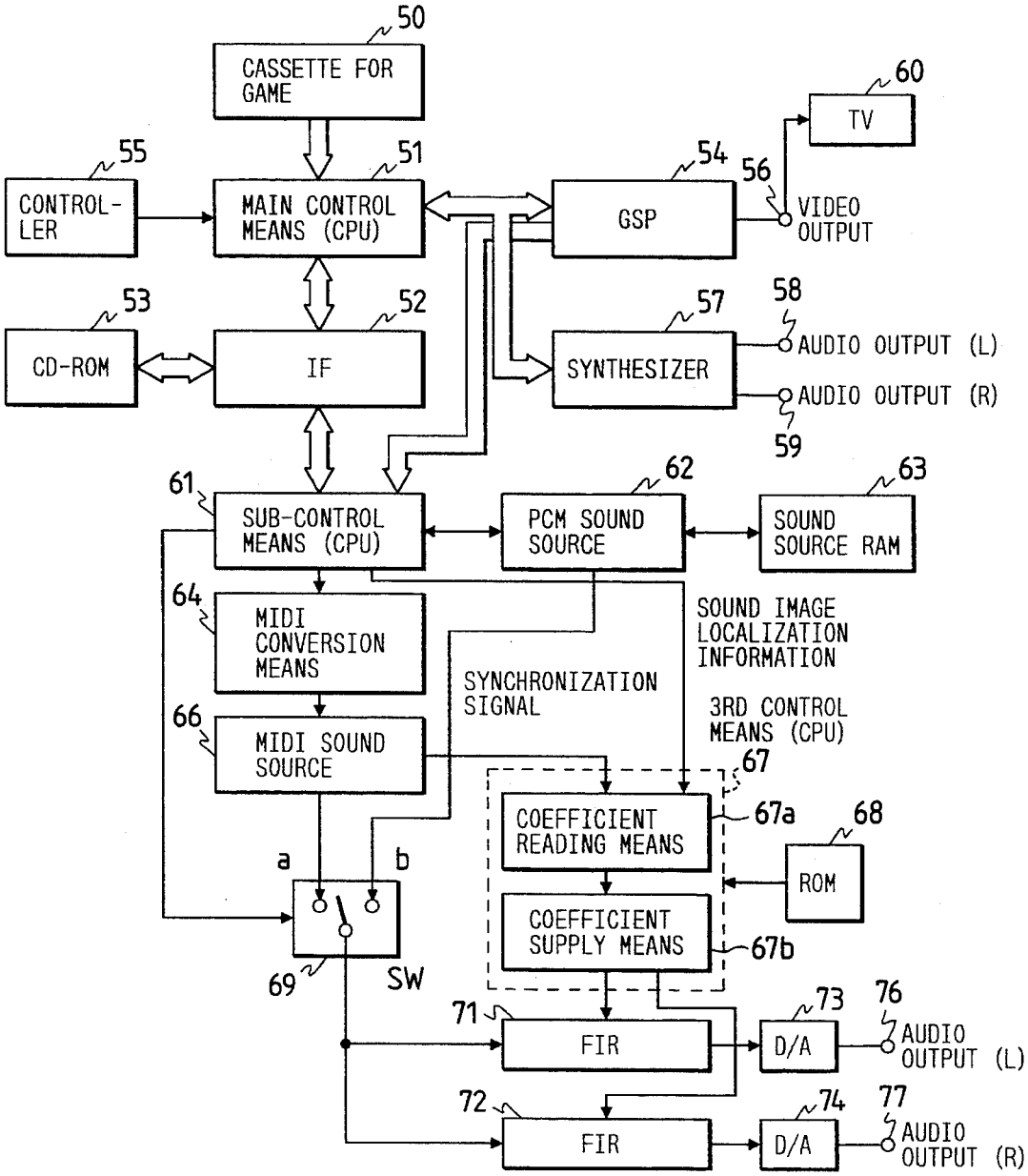
FIG. 10 is a schematic block diagram for illustrating the configuration of an eighth embodiment of the present invention.

FIG. 10 is a schematic block diagram for illustrating the configuration of the eighth embodiment of the present invention.

In case of this embodiment, sound image location data is supplied from the sub-control means 61 to the third control means 67 directly. Further, the predetermined coefficients are read from the storing means 68 by th coefficient reading means 67*a* according to the sound image location data. Furthermore, the transfer of the read coefficients all together to each of the convolvers 71 and 72 is substantially simultaneously commenced by the coefficient supply means 67*b* in response to the synchronization signal sent from the MIDI sound source 66.

In this case, the sound image location (determination) data and a video image are not necessarily in a frame-synchronization (or vertical-synchronization) relation. The supply of the coefficients may be started in response to the synchronization signal at the time as illustrated in FIG. 9(F).

In case of this embodiment, the coefficients are transferred all together by the coefficient supply means 67*b*, substantially simultaneously. Thus, in comparison with the second embodiment of FIG. 8, the time difference among the transfers of the coefficients becomes smaller. Further, at the time of effecting the substantially simultaneous transfer of the coefficients, the coefficients are transferred to the convolvers 71 and 72 gradually in a short time. Thus, this is advantageous in that the transfer characteristics change gradually until the transfer of all of the coefficients are completed and thus noise or the like are hard to occur.

Figure 11:
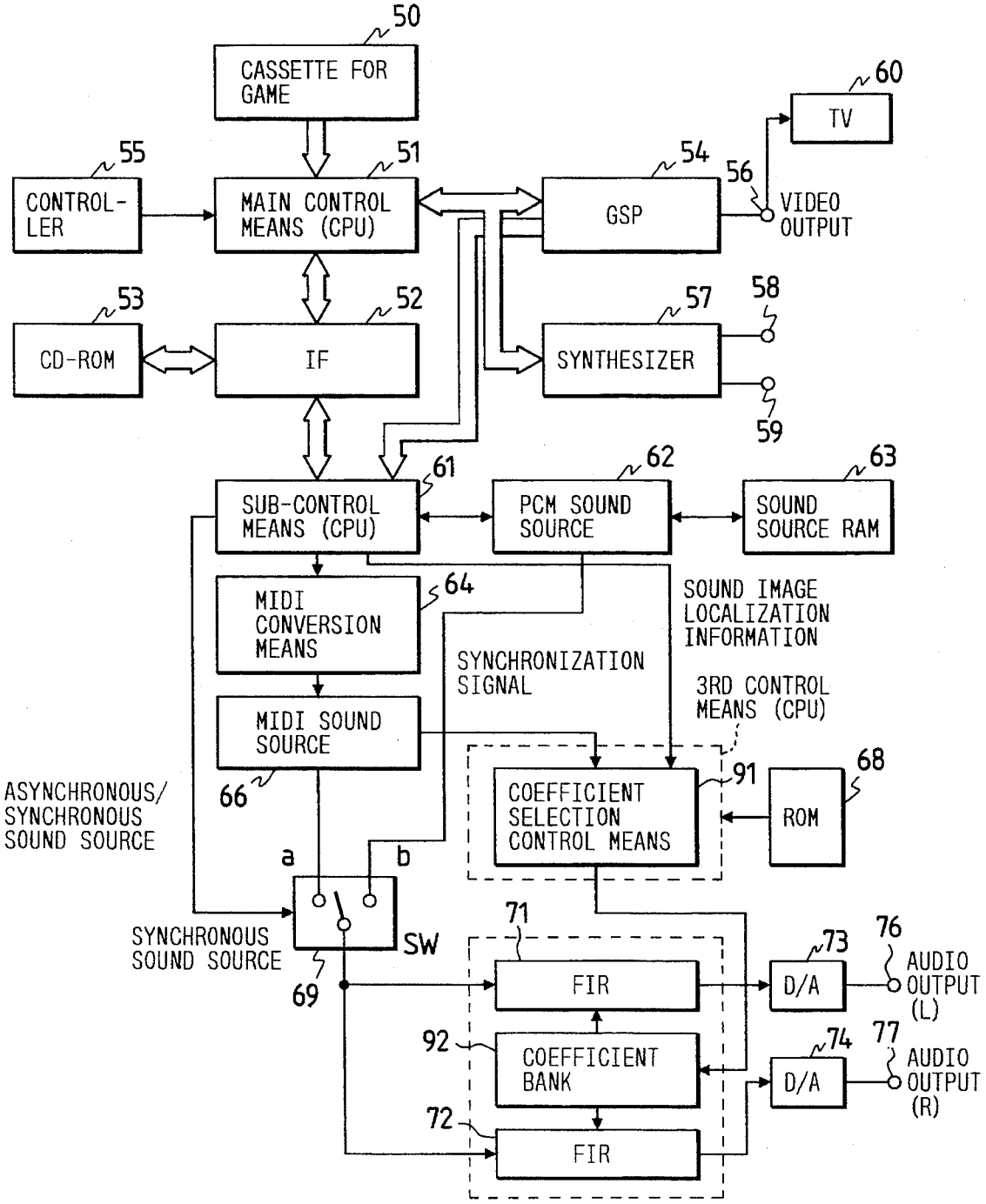
FIG. 11 is a schematic block diagram for illustrating the configuration of a ninth embodiment of the present invention.

FIG. 11 is a schematic block diagram for illustrating the configuration of the ninth embodiment of the present invention. In case of this embodiment, the coefficient supply means 67*b* of the eighth embodiment of FIG. 10 is removed but a coefficient selection control means 91 is provided therein instead of the coefficient reading means 67*a*. Moreover, a coefficient bank (namely, a ROM) 92 for storing the coefficients of the required number is provided as being incorporated with the convolvers 71 and 72. Thus, the coefficients can be changed by the coefficient selection control means 91.

In accordance with the ninth embodiment of the present invention, the coefficient supply means 67*b* becomes unnecessary. The size of the circuit can be small. Moreover, the price of the apparatus can be low.

Furthermore, in cases of the embodiments described previously, the coefficients are read from the ROM 68 correspondingly to each block and then supplied and sequentially written to the RAM of each convolver. Thus, it takes much time to change the coefficients. Namely, there occurs a time delay due to the change of the coefficients. In contrast, in case of the ninth embodiment, an occurrence of such a time delay can be prevented by simply changing the coefficients stored in the coefficient bank. Consequently, sounds can be obtained in synchronization with the motion of an image.

Figure 12:
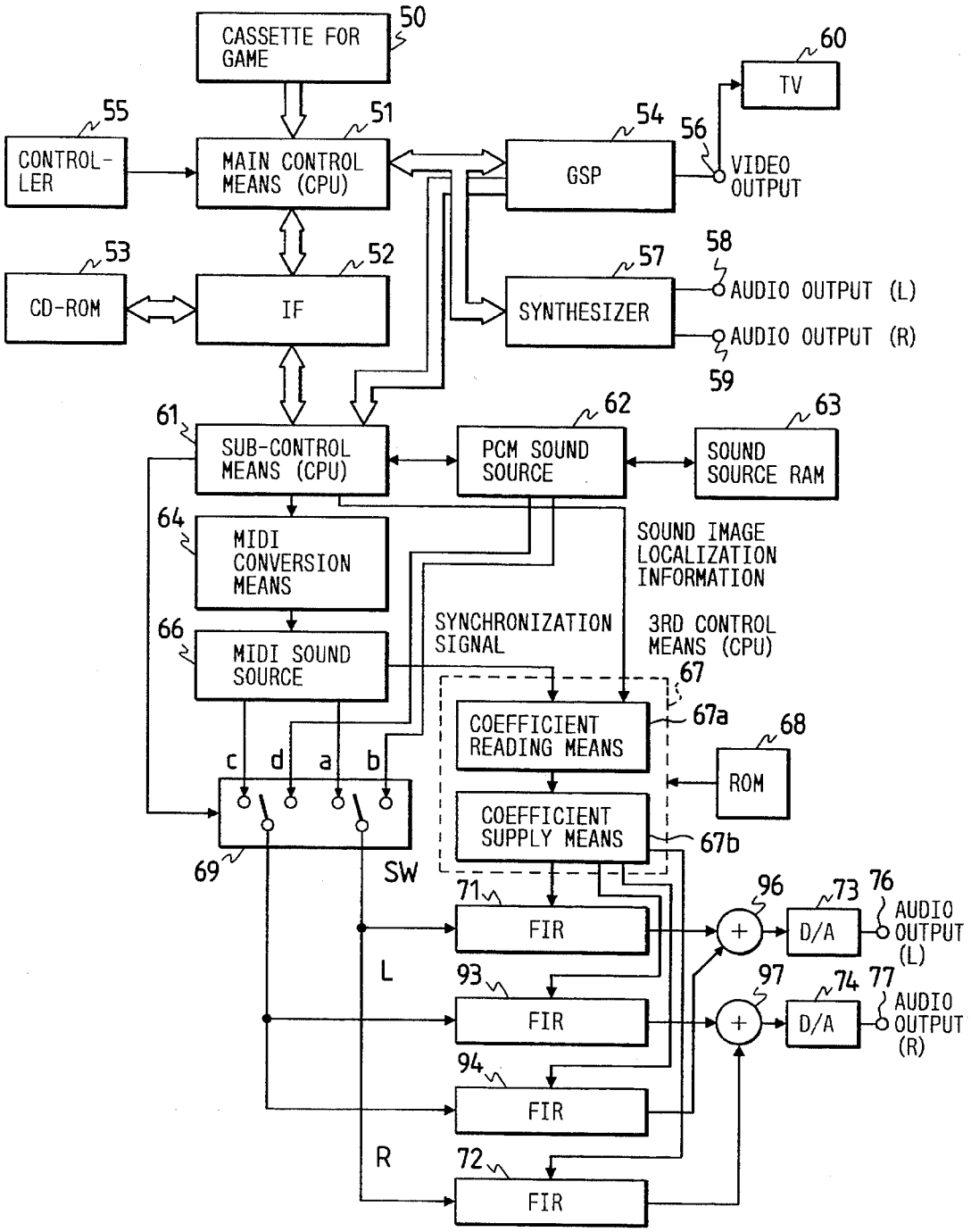
FIG. 12 is a schematic block diagram for illustrating the configuration of a tenth embodiment of the present invention.

FIG. 12 is a schematic block diagram for illustrating the configuration of the tenth embodiment of the present invention. In cases of the seventh to ninth embodiments, a single sound image is assumed and thus the pair of the convolvers are provided corresponding to each of the left and right speakers. In contrast, in case of the tenth embodiment, two sound images are assumed and another pair of the convolvers are added to the eighth embodiment of FIG. 10.

Namely, each of the MIDI sound source 66 and the PCM sound source 62 is connected to the switch 69 through two lines. Further, the second convolvers 93 and 94 are added correspondingly to the added sound image.

Thereby, two sound images can be localized at positions, which are different from the actual positions of the speakers, in a large space as subtending a visual angle of more than 180 degrees at the listener's eye. For instance, in case where the scene of a dogfight between two fighters is inserted into a game, the sound images of the fighters can be localized in synchronization with the displayed scene.

Figure 13:
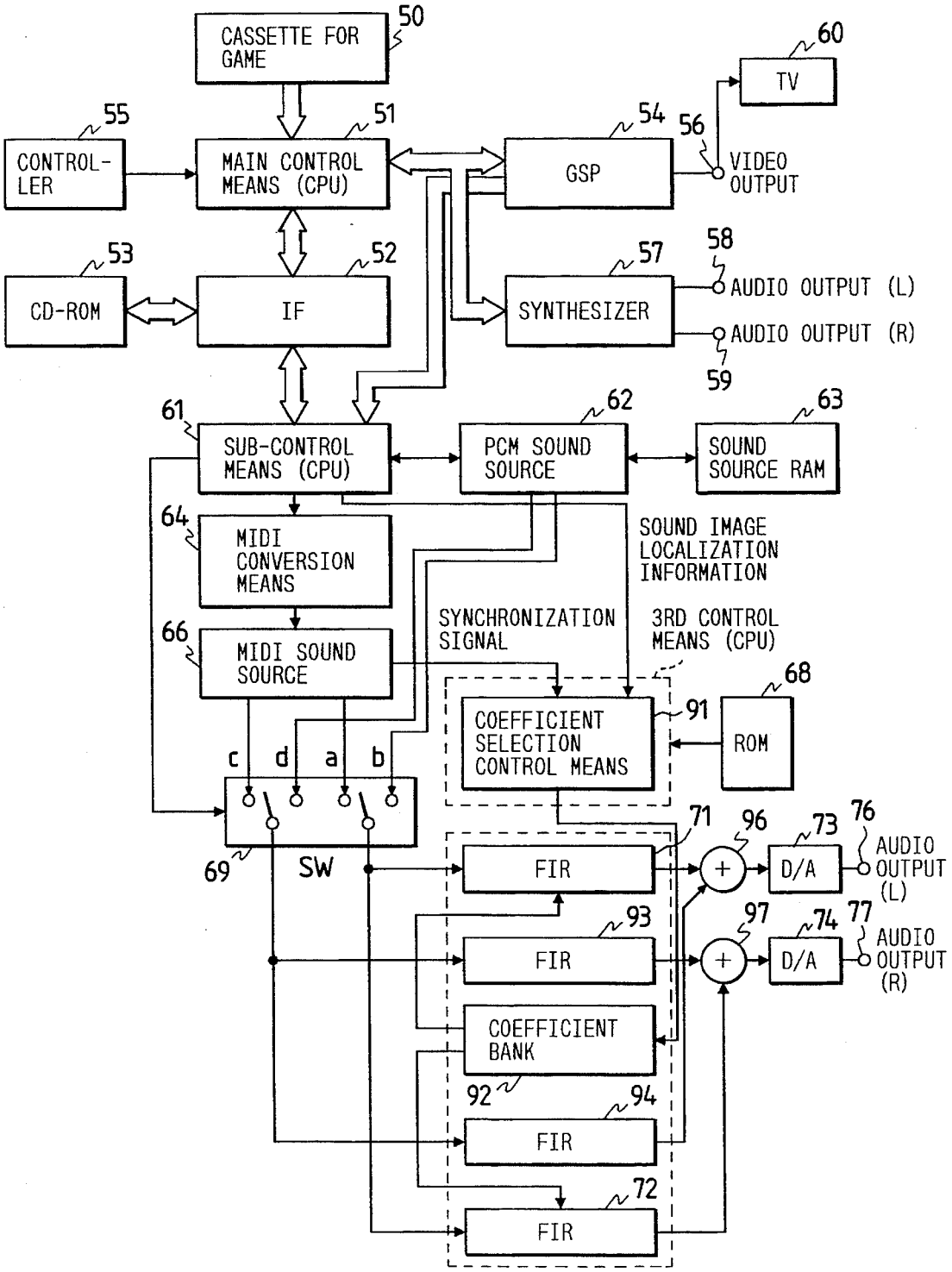
FIG. 13 is a schematic block diagram for illustrating the configuration of an eleventh embodiment of the present invention.

FIG. 13 is a schematic block diagram for illustrating the configuration of the eleventh embodiment of the present invention. In case of the eleventh embodiment, two sound images are assumed similarly as in case of the fourth embodiment. Further, each of the MIDI sound source 66 and the PCM sound source 62 is connected to the switch 69 through two lines. Moreover, the second convolvers 93 and 94 are added correspondingly to the added sound image. Namely, the pair of the convolvers are added to the ninth embodiment of FIG. 11.

In case of the eleventh embodiment, two sound images can be localized at positions, which are different from the actual positions of the speakers, in a large space as subtending a visual angle of more than 180 degrees at the listener's eye. In addition, the coefficient bank 92 is provided therein and the storing means and the coefficient supply means are removed. Thus, the size of the circuit can be small. Further, the price of the apparatus can be low.

Furthermore, the coefficients are substantially simultaneously changed to those stored in the coefficient bank 92. Thus there is no time delay in the change of the coefficients. Furthermore, the eleventh embodiment can provide or achieve a sound image localization in synchronization with the motion of a video image (namely, a moving image).

Figure 14:
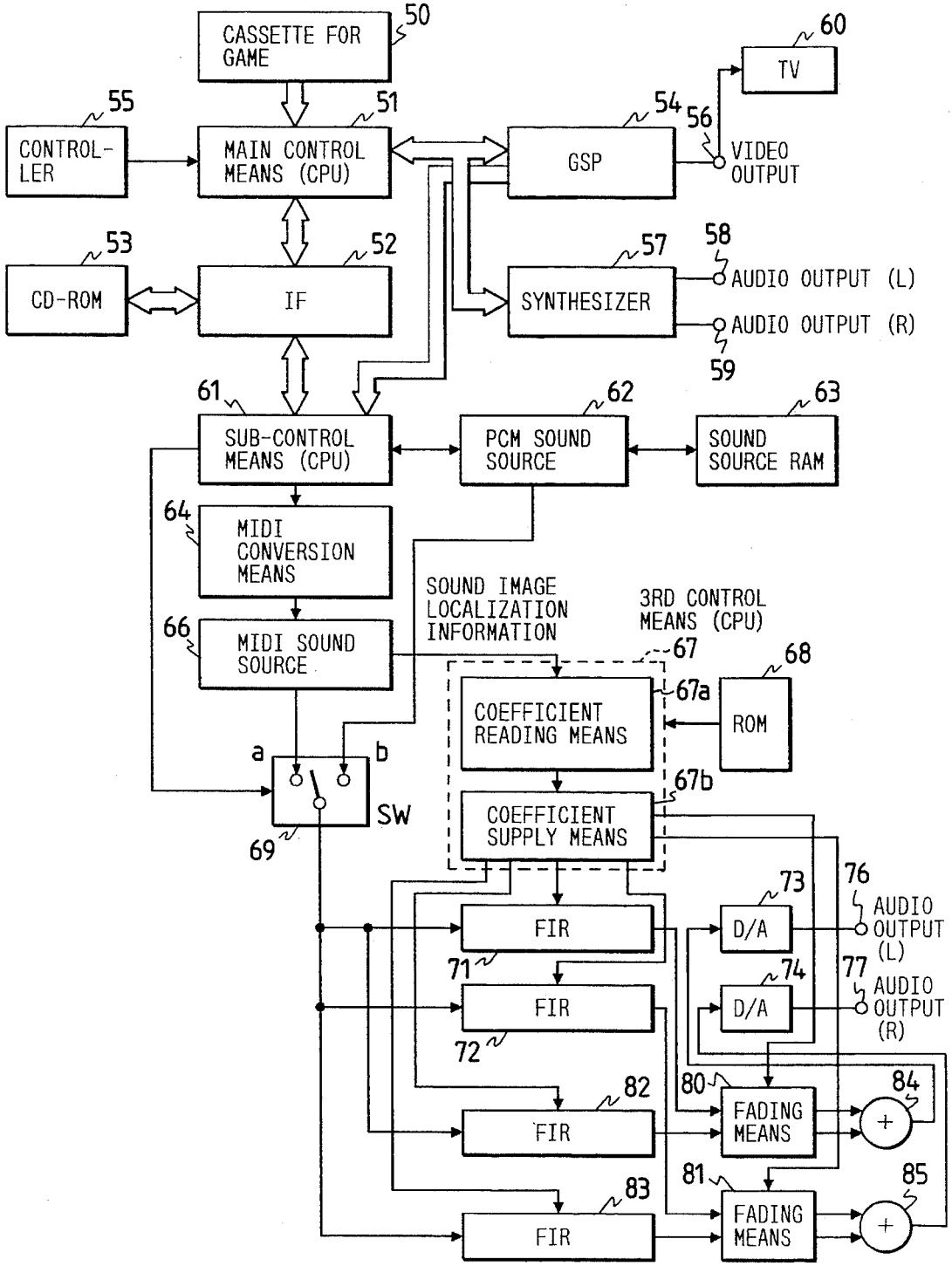
FIG. 14 is a schematic block diagram for illustrating the configuration of a twelfth embodiment of the present invention.

FIG. 14 is a schematic block diagram for illustrating the configuration of the twelfth embodiment of the present invention.

This embodiment is provided with the convolvers 82 and 83 in parallel with each other in addition to the convolvers 71 and 72 as provided in the seventh embodiment of FIG. 8. Further, fading means 80 and 81 and adders 84 and 85 are connected to the output terminals of the convolvers 82 and 83, as shown in this figure.

FIGS. 15(A) to 15(G) are diagrams for illustrating the cross fading processing to be performed in the twelfth embodiment of the present invention. Note that the charts of FIGS. 15(A) to 15(E) are the same with those of FIGS. 9(A) to 9(s).

For instance, similarly to the description of the process with reference to FIG. 6, a process will be described in a case where the apparatus now performs an operation of localizing a sound image at a location corresponding to an azimuth angle of 60 degrees and the apparatus next performs an operation of localizing a sound image at another location corresponding to an azimuth angle of 90 degrees. In such a case, one of the couples of the convolvers (for instance, the first couple of the convolvers 71 and 72) are supplied with the coefficients corresponding to the azimuth angle of 60 degrees and are in action. In contrast, the other couple of the convolvers (namely, the second couple of the convolvers 82 and 83) are not in action.

If sound image localization data representing change of the sound image location from that corresponding to the azimuth angle of 60 degrees to that corresponding to the azimuth angle of 90 degrees is given to the third control means 67 when the apparatus is in such a state, the coefficient reading means 67*a* reads the corresponding coefficients from the ROM 68. Further, the coefficient supply means 67*b* feeds the read coefficients to the second convolvers 82 and 83. Further, the control means 87 supplies a cross fading control signal to the faders 80 and 81 of FIGS. 15(F) and 15(G).

Figures 15A, 15B, 15C, 15D, 15E, 15F, 15G:
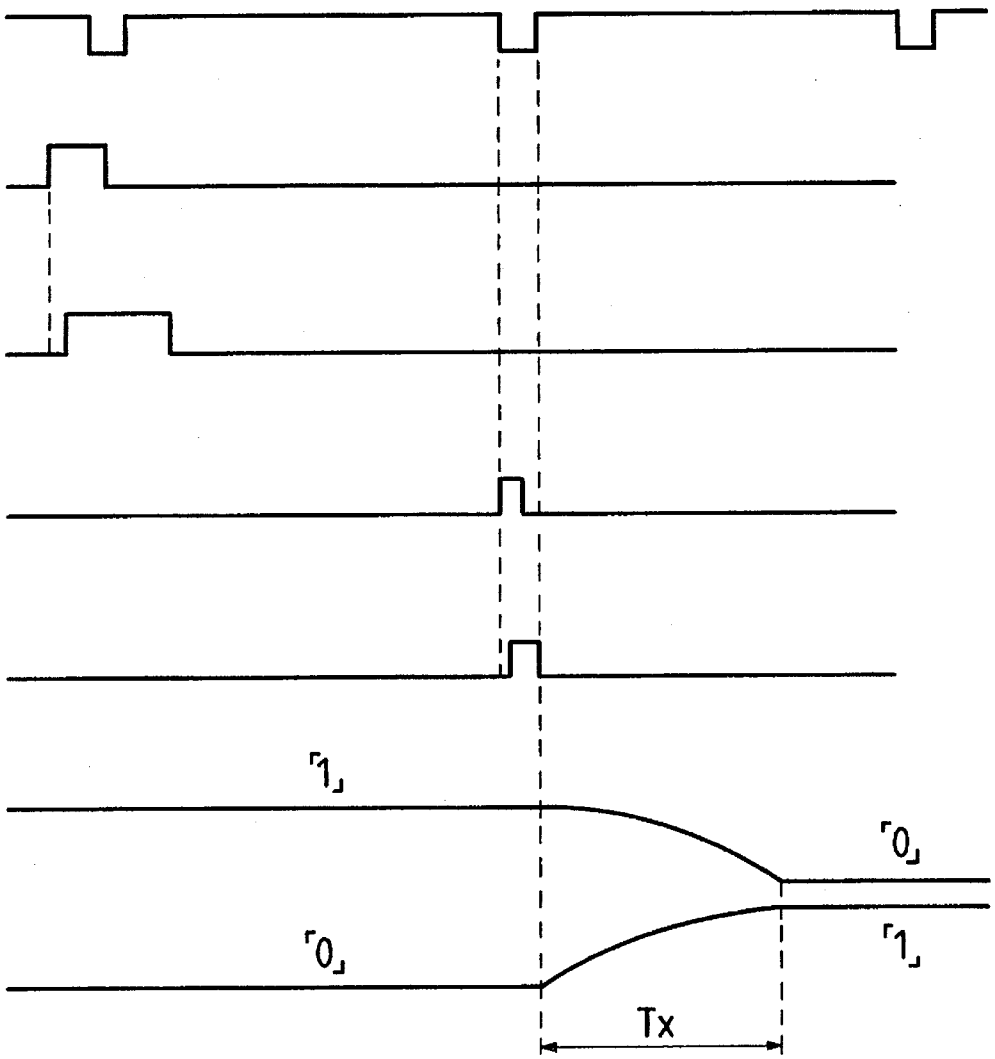
FIGS. 15(A) to 15(G) are diagrams for illustrating a cross fading processing to be performed in the twelfth embodiment of the present invention.

Then, the faders 80 and 81 operate as illustrated in FIGS. 15(F) and 15(G) in response to the cross fading control signal. As the result, outputs of the first couple of the convolvers 71 and 72 are faded out (see FIG. 15(F)). In contrast, outputs of the second couple of the convolvers 82 and 83 are faded in (see FIG. 15(G)). Thus, the convolvers to be used are changed from the first couple of the convolvers 71 and 72 to the second couple of the convolvers 82 and 83, performing a cross fading during a period of time TX.

Figure 16:
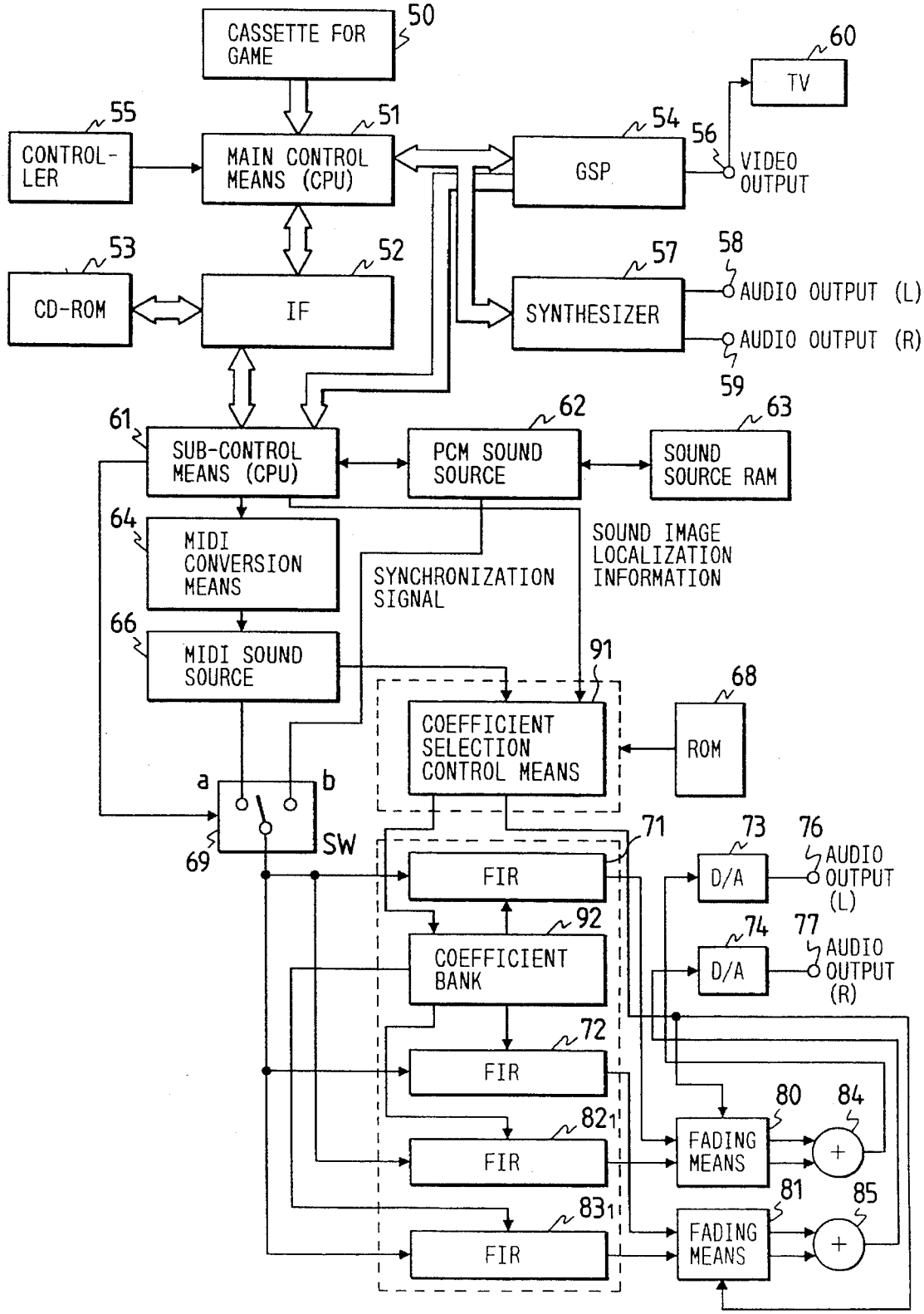
FIG. 16 is a schematic block diagram for illustrating the configuration of a thirteenth embodiment of the present invention.

FIG. 16 is a schematic block diagram for illustrating the configuration of the thirteenth embodiment of the present invention.

This embodiment is provided with the convolvers $\mathbf{82}_1$ and $\mathbf{83}_1$ in parallel with each other in addition to the convolvers 71 and 72 as provided in the seventh embodiment of FIG. 8. Further, fading means 80 and 81 and adders 84 and 85 are connected to the output terminals of the convolvers $\mathbf{82}_1$ and $\mathbf{83}_1$, as shown in this figure.

In case of the thirteenth embodiment, the cross fading can be achieved similarly as in case of the embodiments described above. Incidentally, in cases of the sixth, twelfth and thirteenth embodiments, the fading means is provided at side of the output terminal of each of the convolvers. However, the fading means may be provided at side of the input terminal of each of the convolvers.

Further, in cases of the above-mentioned embodiments, the operation of transferring the coefficients has been described as being completed within the blanking period of the field or frame synchronization signal. However, even if the transfer takes time and the transfer time is longer than the blanking period by, for example, a period of several milliseconds as illustrated in FIG. 9(G), the synchronous relation can be substantially maintained and thus the operation can be carried out without hindrance. In short, as long as the synchronous relation is substantially maintained, there is no obstacle to the operation.

Moreover, in case of each of the embodiments stated above, the headphones may be employed as the transducers, instead of the pair of the speakers sp1 and sp2. In this case, the conditions of measurement of HRTF (or the transfer characteristics) are different from those used in the above described embodiments. Thus, other sets of coefficients are prepared and a set of the coefficients to be used is changed according to the reproducing conditions.

Furthermore, in case where the coefficients of the convolvers are "long" (namely, the number of the coefficients of the convolvers is large), each set of the coefficients may be divided into several parts thereof corresponding to a plurality of convolvers.

Additionally, only groups of the coefficients of the convolvers corresponding to a semicircle portion (namely, corresponding to the azimuth angles θ from 0 to 180 degrees) may be prepared in the coefficient ROM. Regarding the coefficients corresponding to the remaining semicircle portion, only data or information representing the bisymmetry of the coefficients may be prepared or stored in the coefficient ROM. Namely, the coefficients corresponding to the remaining semicircle portion may be supplied to the convolvers by utilizing the bisymmetry of the coefficients.

While preferred embodiments of the present invention have been described above, it is to be understood that the present invention is not limited thereto and that other modifications will be apparent to those skilled in the art without departing from the spirit of the invention. The scope of the present invention, therefore, is to be determined solely by the appended claims.

What is claimed is:

1. A sound image localization control apparatus for reproducing sounds from signals supplied from a sound source through a pair of convolvers by using a pair of transducers disposed apart from each other and for controlling sound image localization to make a listener feel that the listener hears sounds from a sound image localized at a desired sound image location different from positions of the transducers, comprising:

a pair of convolvers, each convolver performing a convolution operation on the signals supplied from the sound source according to coefficients set therein;

storing means for storing groups of coefficients of the convolvers calculated as impulse responses on the basis of head-related transfer functions measured at each sound image location by performing an operation of converging a number of the coefficients of each group to a predetermined number, and an operation of scaling the coefficients of each group to a predetermined level; and coefficient supply means for reading a group of the coefficients corresponding to a designated sound image location from the storing means and supplying the read group of the coefficients to the pair of the convolvers.

2. A sound image localization control apparatus for reproducing sounds from signals supplied from a sound source through a pair of convolvers by using a pair of transducers disposed apart from each other, and for controlling sound image localization to make a listener feel that the listener hears sounds from a sound image localized at a desired sound image location different from positions of the transducers, comprising:

a pair of convolvers, each convolver performing a convolution operation on the signals supplied from the sound source according to coefficients set therein;

storing means for storing groups of coefficients of the convolvers calculated as impulse responses on the basis of head-related transfer functions measured at each sound image location by performing an operation of converging a number of the coefficients of each group to a predetermined number and an operation of scaling the coefficients of each group to a predetermined level;

sound source selection means for selecting a designated sound source from a plurality of sound sources and supplying data representing the designated sound source to the pair of the convolvers; and coefficient supply means for reading a group of the coefficients corresponding to a designated sound image location from the storing means and supplying the read group of coefficients to the pair of the convolvers.

3. The sound image localization control apparatus according to claim 1 or 2, wherein the storing means is a read/write memory and wherein the groups of the coefficients are externally supplied to the storing means.

4. The sound image localization control apparatus according to claim 1 or 2, which further comprises input means for illputting system information on the apparatus and wherein a group of the coefficients are selected according to the system information.

5. The sound image localization control apparatus according to claim 1 or 2, which further comprises gain control means for controlling a gain of the signal supplied from the sound source and supplying the gain controlled signal to the pair of the convolvers.

6. The sound image localization control apparatus according to claim 1 or 2, which further comprises a second pair of convolvers.

7. The sound image localization control apparatus according to claim 1 or 2, which further comprises an auxiliary transducer and addition means for adding signals obtained as results of the operations performed by the pair of convolvers and supplying said added signals to the auxiliary transducer.

8. The sound image localization control apparatus according to claim 1 or 2, which further comprises a second pair of convolvers and cross fading means for performing a cross fading by using the convolvers.

9. The sound image localization control apparatus according to claim 1 or 2, which further comprises:

a game controller for performing an operation of controlling a game;

frame image generating means for generating a frame image;

control means for receiving video display data, audio data and sound image localization information which are used to reproduce a predetermined image and sound, and for generating sound image localization information according to the operation of the game controller; and synchronization control means for controlling sound image localization substantially in synchronization with a subsequently generated the frame image.

10. The sound image localization control apparatus according to claim 1 or 2, which further comprises:

a game controller for controlling a game;

control means for receiving video display data, audio data and sound image localization information which are used to reproduce a predetermined image and sound, and for generating sound image localization information according to the operation of the game controller; and synchronization means for instructing the coefficient supply means to start supplying the coefficients to the pair of the convolvers within a vertical synchronization blanking period of the image.

11. The sound image localization control apparatus according to claim 1 or 2, which further comprises:

a game controller for controlling a game;

control means for receiving video display data, audio data and sound image localization information which are used to reproduce a predetermined image and sound, and for generating sound image localization information according to the operation of the game controller;

coefficient selection control means responsive to the sound image localization information for selecting a group of the coefficients corresponding to the sound image ocalization information to read the selected group of the coefficients; and synchronization means for instructing the coefficient supply means to start supplying the coefficients to the pair of the convolvers within a vertical synchronization blanking period of the image.

* * * * *